US010309096B2

(12) United States Patent
Levin

(10) Patent No.: US 10,309,096 B2
(45) Date of Patent: Jun. 4, 2019

(54) CANTILEVERED WATERCRAFT CANOPY

(71) Applicant: Designer Direct, Inc., Des Plaines, IL (US)

(72) Inventor: Kerry Levin, Des Plaines, IL (US)

(73) Assignee: Designer Direct, Inc., Des Plaines, IL (US)

( * ) Notice: Subject to any disclaimer, the term of this patent is extended or adjusted under 35 U.S.C. 154(b) by 0 days.

(21) Appl. No.: 15/686,105

(22) Filed: Aug. 24, 2017

(65) Prior Publication Data

US 2017/0350156 A1 Dec. 7, 2017

Related U.S. Application Data

(60) Division of application No. 15/380,908, filed on Dec. 15, 2016, now Pat. No. 9,777,504, which is a (Continued)

(51) Int. Cl.
*E04H 15/36* (2006.01)
*B63B 17/02* (2006.01)

(Continued)

(52) U.S. Cl.
CPC ..... *E04B 1/3416* (2013.01); *B63B 17/02* (2013.01); *E02B 3/064* (2013.01); *E04H 15/18* (2013.01);

(Continued)

(58) Field of Classification Search
CPC ..... E04H 15/18; E04H 15/36; E04H 15/54; E04H 15/58; E04H 6/025; B62B 17/02; B63B 17/02; E04B 1/3416

(Continued)

(56) References Cited

U.S. PATENT DOCUMENTS 302,535 A 7/1884 Holabird
394,262 A 12/1888 Gentzen (Continued)

FOREIGN PATENT DOCUMENTS

CA 1289436 9/1991
CA 02088948 8/1994

(Continued)

OTHER PUBLICATIONS

Pier-port 4, Youtube Video, https://www.youtube.com/watch?v=ZFcdmitfB1Q, Dec. 26, 2014 (Includes dated web page print followed by page of still images summarizing video)(Grace Period Disclosure).

(Continued)

*Primary Examiner* — Robert Canfield
(74) *Attorney, Agent, or Firm* — Steven L. Fisher-Stawinski

(57) ABSTRACT

In a cantilevered watercraft canopy, a plurality of vertical supports provides support to a plurality of horizontal supports. First and second main struts are supported by the horizontal supports. First and second pluralities of arch members are affixed at a central attachment point to the first main strut and second main strut, respectively. The outer ends of the first and second pluralities of arch members support outer struts. In the first exemplary embodiment, the inner ends of the first and second pluralities of arch members are affixed to one another, and the main struts are affixed rigidly to the horizontal supports. In the second exemplary embodiment, first and second inner struts are affixed to the inner ends of the first and second pluralities of arch members, and the main struts are affixed rotatably to the horizontal supports. A canopy cover is affixed over the arch members and struts.

19 Claims, 18 Drawing Sheets

Related U.S. Application Data continuation of application No. 14/697,584, filed on Apr. 27, 2014, now Pat. No. 9,556,640.

(60) Provisional application No. 61/984,394, filed on Apr. 25, 2014, provisional application No. 62/152,969, filed on Apr. 26, 2015.

(51) Int. Cl.

| | |
|---|---|
| ***E04B 1/34*** | (2006.01) |
| ***E02B 3/06*** | (2006.01) |
| ***E04H 15/18*** | (2006.01) |
| ***E04H 15/54*** | (2006.01) |
| ***E04H 15/58*** | (2006.01) |
| ***E04H 15/64*** | (2006.01) |
| *E04H 6/02* | (2006.01) |

(52) U.S. Cl.
CPC ..... *E04H 15/36* (2013.01); *E04H 15/54* (2013.01); *E04H 15/58* (2013.01); *E04H 15/64* (2013.01); *E04H 6/025* (2013.01)

(58) Field of Classification Search
USPC ..... 135/124, 158, 160
See application file for complete search history.

(56) References Cited

U.S. PATENT DOCUMENTS 413,730 A 10/1889 Palmer
498,583 A 5/1893 Smaley
528,393 A 10/1894 Rinn
1,051,252 A 1/1913 Parker
1,158,356 A 10/1915 Wilson
1,388,478 A 8/1921 Nelson
1,448,821 A 3/1923 Andrews
1,625,016 A 2/1925 Scott
1,527,908 A 4/1925 Noble
1,538,926 A 5/1925 McDonald
1,593,431 A 7/1926 Buie
1,672,388 A 6/1928 McWilliam
1,953,514 A 4/1934 Skagerberg
2,182,283 A 12/1939 Curtis
2,425,079 A * 8/1947 Billig ..... B63B 3/62 114/65 A
2,708,346 A 5/1955 Smith
2,845,078 A * 7/1958 Singleton ..... E04H 6/025 135/118
3,030,973 A 4/1959 Janda
D186,656 S * 11/1959 Vetare ..... D25/18
2,912,703 A 11/1959 Murphy
2,930,387 A 3/1960 Streich
3,003,507 A 10/1961 Ferris
3,023,732 A * 3/1962 Everett ..... A01K 1/02 119/498
D194,584 S * 2/1963 Weber ..... D25/13
3,083,540 A 4/1963 Smith
3,242,620 A 3/1966 Kaiser
3,410,036 A * 11/1968 Franz ..... E04B 1/24 52/122.1
3,425,428 A 2/1969 Schwartz
3,441,037 A 4/1969 Transeau
3,869,836 A * 3/1975 Allen ..... E04B 1/34336 52/146
4,312,157 A 1/1982 Hertel
4,363,284 A 12/1982 Monroe
4,683,901 A * 8/1987 Mitchell ..... E04H 6/00 114/263
4,825,890 A * 5/1989 Castlebury ..... A63B 9/00 135/115
4,898,198 A * 2/1990 Castlebury ..... A63G 9/00 135/117
5,086,799 A 2/1992 Lumbleau
5,152,109 A 10/1992 Boers
5,185,972 A 2/1993 Markiewiecz
5,314,377 A * 5/1994 Pelosi, III ..... F24F 3/161 454/187
5,331,917 A 7/1994 Magers
5,419,273 A 5/1995 Cutler
5,425,327 A 6/1995 Zirkelbach
D363,790 S * 10/1995 Boyd ..... D25/56
5,520,139 A 5/1996 King
5,573,026 A * 11/1996 Griffith ..... B63B 17/023 114/361
5,575,301 A * 11/1996 Bolton ..... A01K 1/0035 135/122
5,632,290 A 5/1997 Kuo
5,697,320 A 12/1997 Murray
5,709,501 A 1/1998 Elbers
5,775,353 A 7/1998 Johnson
D403,081 S * 12/1998 Luzzardi ..... D25/56
5,904,114 A 5/1999 Wright
D412,993 S * 8/1999 Chipman ..... D25/56
5,967,162 A 10/1999 Bolton
5,979,125 A 11/1999 Guillet
D420,812 S * 2/2000 Chipman ..... D6/335
6,032,433 A 3/2000 Hatziathanasiou
6,073,587 A 6/2000 Hill
6,360,492 B1 3/2002 Ross
D468,837 S * 1/2003 Shilling ..... D25/56
6,505,638 B1 1/2003 Powell
6,615,550 B2 9/2003 Reuschel
6,684,893 B2 2/2004 Kuo
6,688,252 B1 2/2004 Caravella
6,691,723 B2 2/2004 Godberson
6,976,806 B2 12/2005 Edson
7,001,104 B2 2/2006 Edson
7,055,538 B2 * 6/2006 Deng ..... E04H 15/50 135/117
D530,022 S * 10/2006 Haymann ..... D25/56
7,353,769 B2 4/2008 Unrast
7,389,785 B2 6/2008 Loudermilk
7,392,816 B2 7/2008 Porter
7,401,569 B2 7/2008 Jones
D584,420 S 10/2008 Gibson
7,527,014 B2 5/2009 Hey
D595,865 S * 7/2009 Magnusson ..... D25/56
7,555,994 B1 7/2009 Arnall
7,669,542 B2 3/2010 Donahue
7,814,723 B2 10/2010 VanElverdinghe
7,913,710 B2 3/2011 Bougioukos
7,958,839 B2 6/2011 Donahue
D643,937 S * 8/2011 Boesch ..... D25/56
8,286,651 B1 10/2012 Maffett
344,103 A1 3/2013 Kaufman
8,555,910 B2 10/2013 Webster
8,602,043 B2 12/2013 Kaiser
8,667,908 B2 3/2014 Martin
8,783,276 B2 7/2014 Skrzynski
8,789,549 B1 7/2014 Barnes
8,857,366 B2 10/2014 Russikoff
8,944,399 B2 3/2015 Sutherland
9,153,718 B2 * 10/2015 Richardson ..... E04H 6/025
9,216,798 B2 12/2015 Kent
9,272,754 B1 3/2016 Craig
9,404,281 B1 * 8/2016 Donnay ..... E04H 15/36
9,556,640 B2 1/2017 Levin
9,776,687 B2 * 10/2017 Levin ..... B63B 17/02
9,926,720 B2 * 3/2018 Huang ..... E04H 15/322
2003/0056818 A1 * 3/2003 Connelly ..... E04H 15/44 135/117
2003/0062074 A1 3/2003 Kuo
2003/0084934 A1 5/2003 Goldwitz
2003/0131539 A1 7/2003 Burford
2003/0183275 A1 10/2003 Lee
2003/0188775 A1 * 10/2003 Connelly ..... E04H 15/44 135/117
2004/0226594 A1 * 11/2004 Connelly ..... E04H 15/44 135/117
2005/0016438 A1 1/2005 Hey
2005/0161071 A1 7/2005 Tseng
2005/0252542 A1 11/2005 Basta
2005/0259545 A1 11/2005 Yun

(56) References Cited

U.S. PATENT DOCUMENTS

| | | | | |
|---|---|---|---|---|
| 2005/0262777 | A1* | 12/2005 | Dalo | E04B 1/3416 52/73 |
| 2007/0068634 | A1 | 3/2007 | Unrast | |
| 2007/0295379 | A1* | 12/2007 | Basta | B63C 5/00 135/122 |
| 2010/0051078 | A1* | 3/2010 | Sy-Facunda | E04H 15/48 135/145 |
| 2010/0122718 | A1 | 5/2010 | Lah | |
| 2011/0290292 | A1 | 12/2011 | Kaiser | |
| 2014/0026804 | A1 | 1/2014 | Templeton | |
| 2014/0331569 | A1* | 11/2014 | Spearn | E04F 10/00 52/74 |
| 2015/0308143 | A1 | 10/2015 | Levin | |
| 2016/0129975 | A1* | 5/2016 | Craig | B63B 17/02 135/124 |
| 2016/0289989 | A1* | 10/2016 | Creagh | E04H 6/04 |
| 2016/0368571 | A1* | 12/2016 | Levin | B63B 17/02 |
| 2017/0096834 | A1 | 4/2017 | Levin | |
| 2017/0284081 | A1 | 10/2017 | Craig | |

FOREIGN PATENT DOCUMENTS

| | | | | |
|---|---|---|---|---|
| CA | 2088948 | A1 * | 8/1994 | B63B 17/02 |
| CA | 2916336 | A1 * | 10/2016 | |
| CN | 204112218 | | 1/2015 | |
| DE | 102006019755 | | 4/2006 | |
| EP | 3147428 | A1 * | 3/2017 | |
| FR | 1520912 | A * | 4/1968 | E04B 1/24 |
| FR | 2142243 | A5 * | 1/1973 | E04B 1/3416 |
| FR | 2169482 | A5 * | 9/1973 | E04B 1/3416 |
| WO | WO2011157969 | | 6/2011 | |
| WO | WO2011140557 | | 11/2011 | |

OTHER PUBLICATIONS

Pier-port 6, Youtube Video, https://www.youtube.com/watch?v=p4oxEgZDreQ, Apr. 6, 2015 (Includes dated web page print followed by page of still images summarizing video)(Grace Period Disclosure).

Pier-port 6, Youtube Video, https://www.youtube.com/watch?v=-KR4u5i6ego, Apr. 7, 2015 (Includes dated web page print followed by page of still images summarizing video)(Grace Period Disclosure).

Pier-Port|Cantilevered Boat Canopy, Pier-port.com, the Internet Wayback Machine, Apr. 7, 2015, https://web.archive.org/web/20150407033100/http://pier-port.com/ (Prints and screenshots of dated snapshot)(Grace Period Disclosure).

"Pier Port Canopy", Google Plus Photo Album, https://get.google.com/u/0/albumarchive/110920703178663712557/album/AF1QipNE1WevACOPKOBohs3ZbF67jas087WWCg-mdfpl (19 Photographs dated betweenMay 31, 2014 and Feb. 15, 2015) (Grace Period Disclosure).

* cited by examiner

FIG. 5
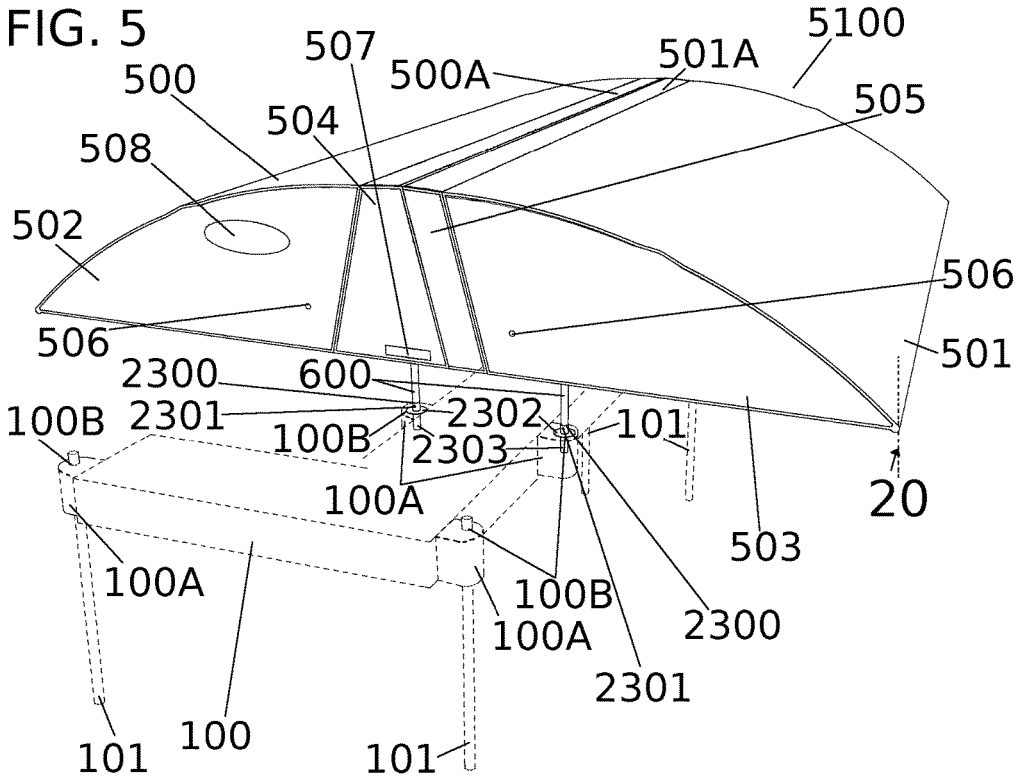
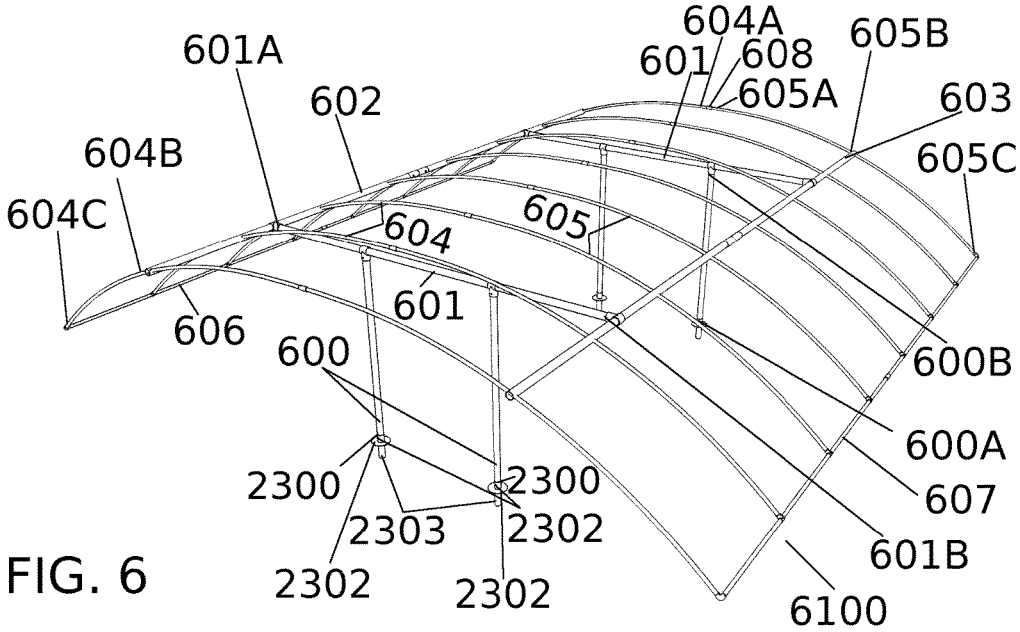
FIG. 6

FIG. 7
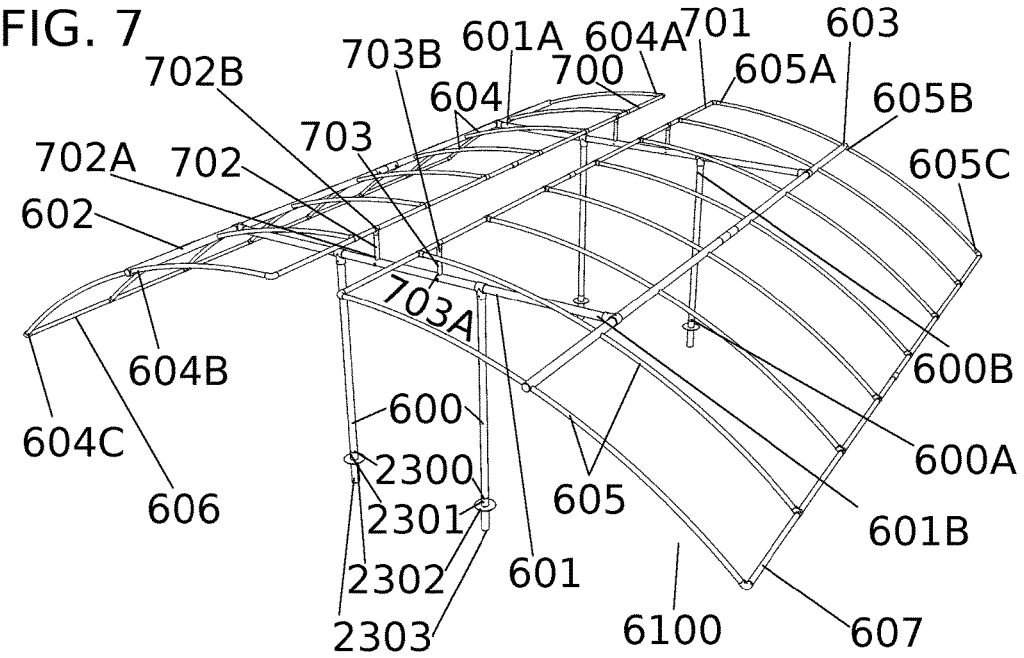
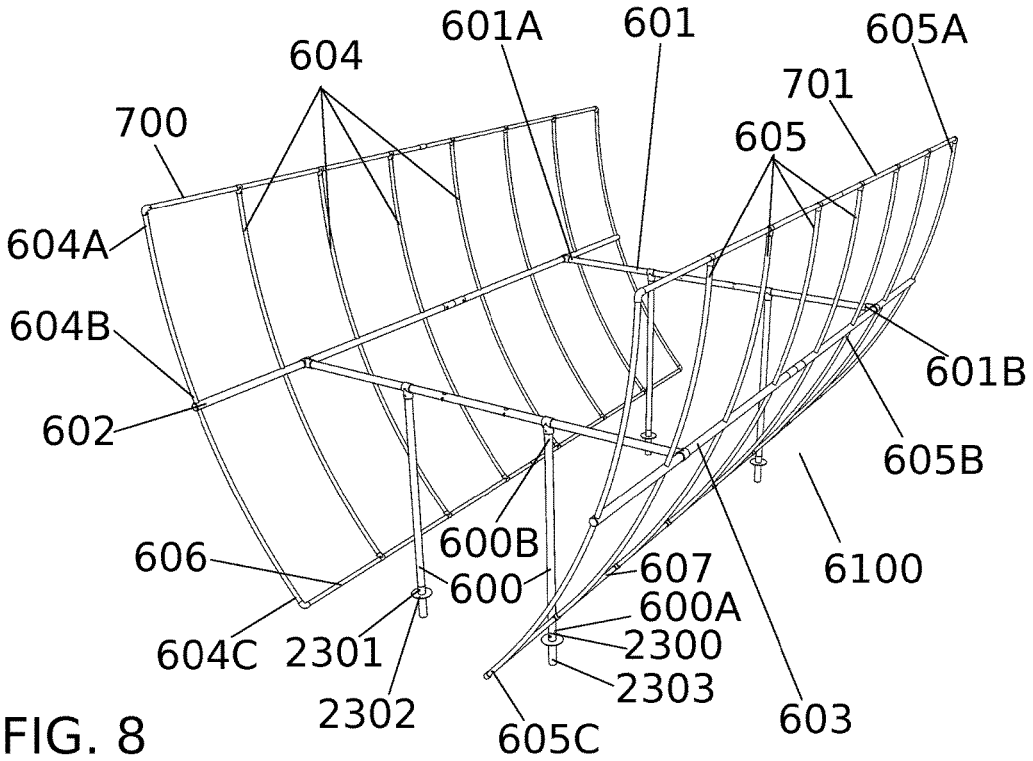
FIG. 8

FIG. 10
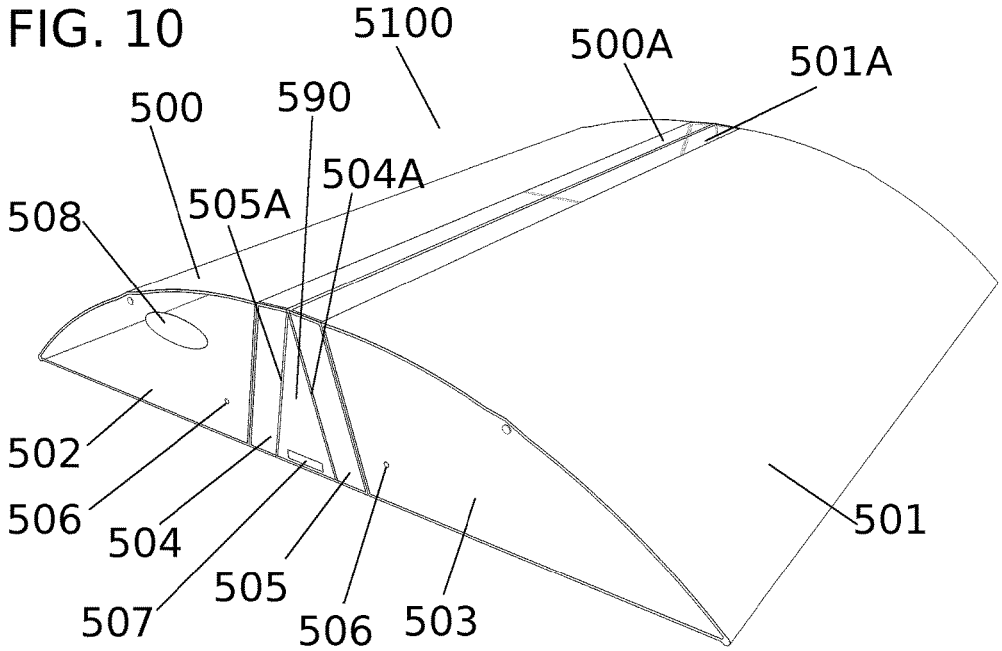
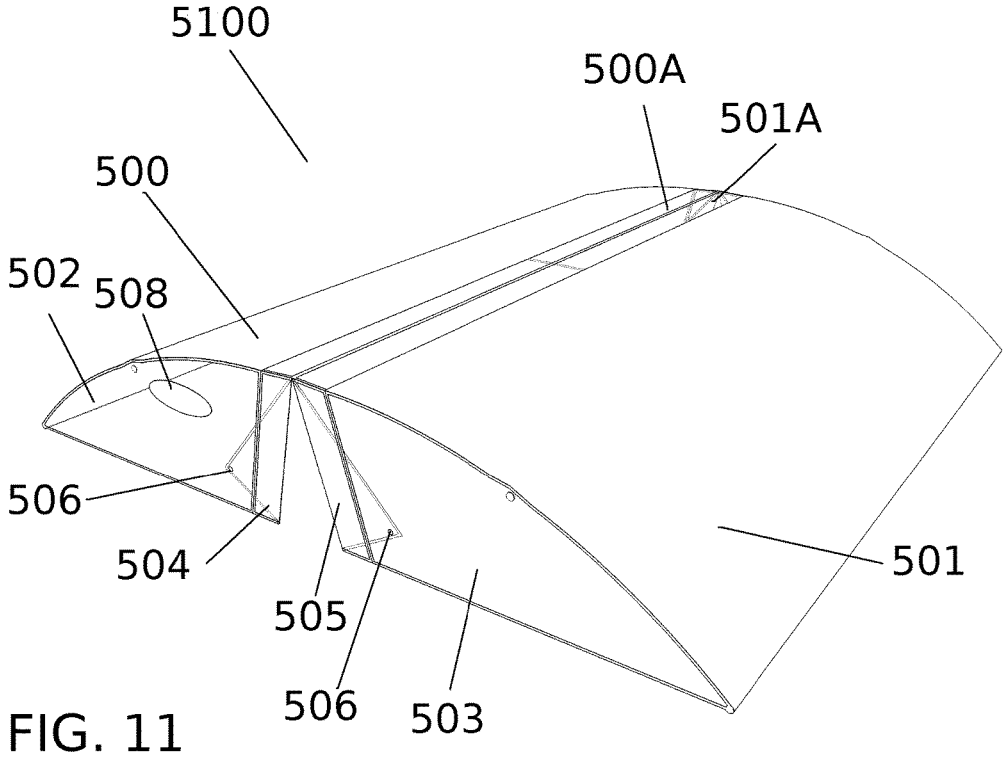
FIG. 11

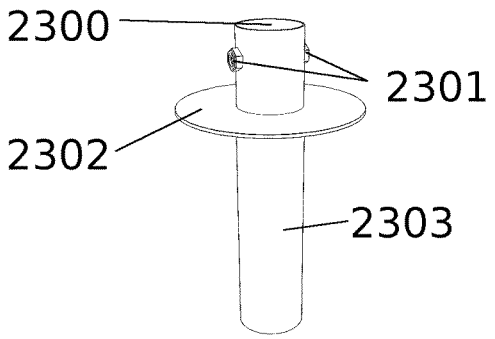
FIG. 23
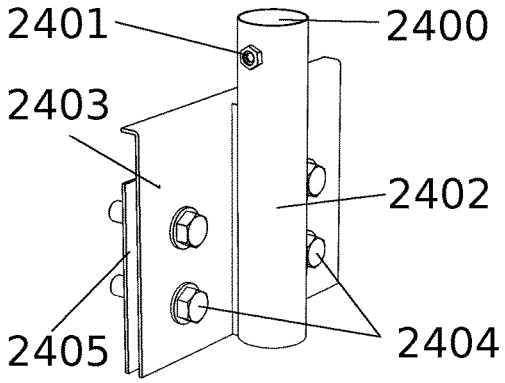
FIG. 24
FIG. 25
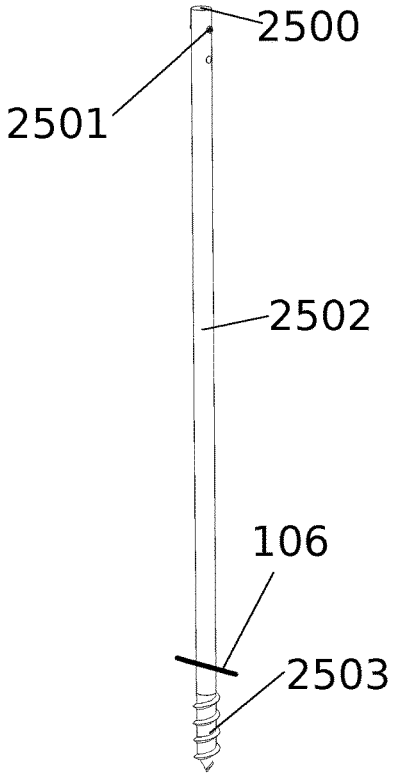
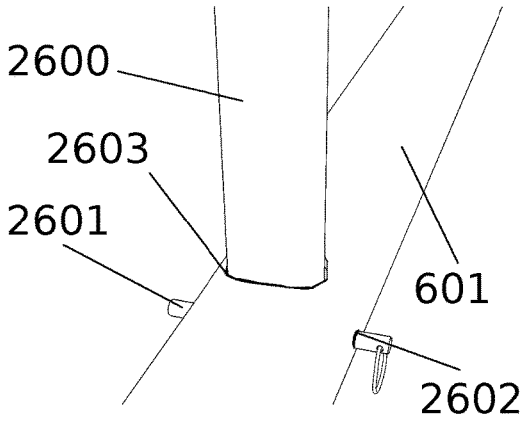
FIG. 26
FIG. 27
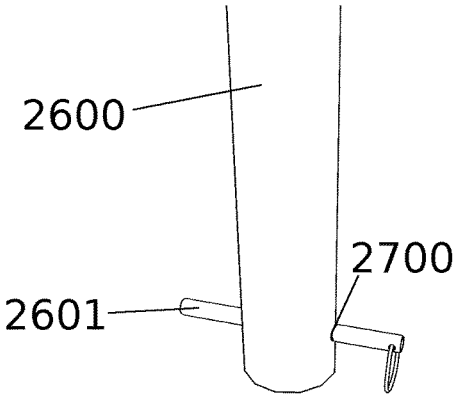

CANTILEVERED WATERCRAFT CANOPY

CROSS-REFERENCE TO RELATED APPLICATIONS

This application claims priority to copending U.S. patent application Ser. No. 14/697,584, filed Apr. 27, 2015, which claims the benefit of U.S. Provisional Application No. 61/984,394, filed on Apr. 25, 2014, and of U.S. Provisional Application No. 62/152,969, filed Apr. 26, 2015, all of which are hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to protective covers and shelters for watercraft and in particular to cantilever covers including canopy frames. Boaters who moor their boats to piers are universally faced with the task of repeatedly covering and then uncovering their watercraft between storage and use configurations. While seemingly simple, this task can be daunting and can greatly diminish enjoyment of the boating experience.

Individual covers exist for most watercraft, but have to be manually taken on and off with a combination of zippers, snaps, and center poles. This task can be time consuming and physically demanding, and, for people with dexterity disabilities, virtually impossible. Often times, boaters skip boating altogether because of the difficulty associated with manual covers. As an alternative, complex and costly mechanical boat cover lifts have been proposed, for example U.S. Pat. No. 4,363,284 to Monroe provides a vertically lifting boat cover that may marginally reduce the hassle involved in covering and uncovering, but without, as in the present invention, providing full access to the boat while covered. Similarly, U.S. Pat. No. 6,688,252 to Caravella provides a liftable boat cover, but requires driving supports that span the mooring area. U.S. Pat. No. 7,353,769 to Unrast provides a cantilevered liftable canopy, which addresses the need to span the mooring area, but still requires complex mechanical action to use and does not provide access to the watercraft without lifting the canopy.

Another alternative is covered boat lifts, which lift the vehicle up into a stationary canopy. Depending on the means of providing power, this activity can be difficult, such as during power outages or when the pulley mechanism has malfunctioned, leaving the boater to temporarily revert back to individual covers. Additionally, this alternative is relatively expensive, both for the initial investment, as well as the ongoing seasonal installation done most often with barges and cranes. Lastly, the lift stations are a disruption to the natural environment, as while in the water they disturb the lake bed with underwater supports and resting pads, and during the off-season are placed helter-skelter along the shorelines, diminishing the public's use and enjoyment of the waterfront.

The present invention addresses this problem by providing a seasonally installed cantilevered canopy that may be affixed to and easily installed from the pier or dock. The canopy of the present invention is easily installed and removed for seasonal use, and it offers protection without mechanical parts or power to operate. By comparison, existing modular canopies, for example U.S. Pat. No. 5,185,972 to Markiewicz, require either opposing supports spanning the mooring area or obstructive cross-bracing on the pier (see Markiewicz at FIG. 1, wherein the posts 14 would either span a mooring area or be in-line with a pier, if the structure shown were used to shelter watercraft). The present invention's cantilevered design avoids the need to have a spanning support and the need for obstructive cross-bracing.

SUMMARY OF THE INVENTION

Accordingly, the invention is directed to a cantilevered watercraft canopy. A plurality of vertical supports provides support to a plurality of horizontal supports. First and second main struts are supported by the horizontal supports. First and second pluralities of arch members are affixed at a central attachment point to the first main strut and second main strut, respectively. The outer ends of the first and second pluralities of arch members support first and second outer struts. In the first exemplary embodiment, the inner ends of the first and second pluralities of arch members are affixed to one another, and the main struts are affixed rigidly to the horizontal supports.

In the second exemplary embodiment, first and second inner struts are affixed to the inner ends of the first and second pluralities of arch members, and the main struts are affixed rotatably to the horizontal supports. A canopy cover is affixed over the arch members and struts.

The canopy cover provides access flaps that may be held back via a closure. The vertical supports may be affixed to a dock or pier via a bracket affixed to the side of a dock or pier. In the case of a floating dock, the vertical supports may be inserted into the guide holes and supported via a stop disc. In the case of an unstable or insufficient dock, the vertical supports may be fitted with an auger pole at the bottom end and driven into the water body bed.

It is an object of the invention to provide a watercraft canopy that replaces the need to cover watercraft during non-use.

It is an object of the invention to provide a watercraft canopy that permits usable access to the watercraft during inclement weather.

It is an object of the invention to provide a watercraft canopy that is easily installed and stricken seasonally.

It is an object of the invention, in its second exemplary embodiment, to provide a watercraft canopy that is installable on and entirely from the dock or pier without requiring access from the water or a watercraft, and without spanning the mooring area.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 5 is an elevated front right perspective view of the first or second exemplary embodiment with the canopy cover installed, displaying the dock 100, the dock guides 100A, the dock guide holes 100B, the floating dock guide poles 101, the first canopy top element 500, the first canopy inner top element 500A, the second canopy top element 501, the second canopy inner top element 501A, the first canopy side elements 502, the second canopy side elements 503, the first door flap 504, the second door flap 505, the door opening fasteners 506, the door closing fastener 507, the logo placement 508, the assembled canopy cover 5100, the vertical supports 600, the vertical support socket 2300, the vertical support socket fastener 2301, the stop disc 2302, and the insertion member 2303, and further displaying the plane of the sectional view of FIG. 20.

FIG. 6 is an elevated front right perspective view of the first exemplary embodiment with the canopy cover not installed, displaying the vertical supports 600, the vertical support bottom ends 600A, the vertical support top ends 600B, the horizontal supports 601, the horizontal support first ends 601A, the horizontal support second ends 601B, the first main strut 602, the second main strut 603, the first arch members 604, the first arch member inner ends 604A, the first arch member central attachment points 604B, the first arch member outer ends 604C, the second arch members 605, the second arch member inner ends 605A, the second arch member central attachment points 605B, the second arch member outer ends 605C, the first outer strut 606, the second outer strut 607, the central arch connections 608, the assembled canopy frame 6100, the vertical support socket 2300, the vertical support socket fastener 2301, the stop disc 2302, and the insertion member 2303.

FIG. 7 is an elevated front right perspective scene of the second exemplary embodiment with the canopy cover not installed and the arch members in the use configuration, displaying the vertical supports 600, the vertical support bottom ends 600A, the vertical support top ends 600B, the horizontal supports 601, the horizontal support first ends 601A, the horizontal support second ends 601B, the first main strut 602, the second main strut 603, the first arch members 604, the first arch member inner ends 604A, the first arch member central attachment points 604B, the first arch member outer ends 604C, the second arch members 605, the second arch member inner ends 605A, the second arch member central attachment points 605B, the second arch member outer ends 605C, the first outer strut 606, the second outer strut 607, the assembled canopy frame 6100, the first inner strut 700, the second inner strut 701, the first secondary vertical supports 702, the first secondary vertical support bottom ends 702A, the first secondary vertical support top ends 702B, the second secondary vertical supports 703, the second secondary vertical support bottom ends 703A, the second secondary vertical support top ends 703B, the vertical support socket 2300, the vertical support socket fastener 2301, the stop disc 2302, and the insertion member 2303.

FIG. 8 is a perspective scene view of the second exemplary embodiment with the canopy cover not installed and the arch members in the installation configuration, displaying the vertical supports 600, the vertical support bottom ends 600A, the vertical support top ends 600B, the horizontal supports 601, the horizontal support first ends 601A, the horizontal support second ends 601B, the first main strut 602, the second main strut 603, the first arch members 604, the first arch member inner ends 604A, the first arch member central attachment points 604B, the first arch member outer ends 604C, the second arch members 605, the second arch member inner ends 605A, the second arch member central attachment points 605B, the second arch member outer ends 605C, the first outer strut 606, the second outer strut 607, the assembled canopy frame 6100, the first inner strut 700, the second inner strut 701, the vertical support socket 2300, the vertical support socket fastener 2301, the stop disc 2302, and the insertion member 2303.

FIG. 10 is an elevated front right perspective view of the canopy cover of the first or second exemplary embodiment with the door flaps in the closed configuration, displaying the first canopy top element 500, the first canopy inner top element 500A, the second canopy top element 501, the second canopy inner top element 501A, the first canopy side elements 502, the second canopy side elements 503, the first door flap 504, the second door flap 505, the door opening fasteners 506, the door closing fastener 507, the logo placement 508, and the assembled canopy cover 5100.

FIG. 11 is an elevated front right perspective view of the canopy cover of the first or second exemplary embodiment with the door flaps in the open configuration, displaying the first canopy top element 500, the first canopy inner top element 500A, the second canopy top element 501, the second canopy inner top element 501A, the first canopy side elements 502, the second canopy side elements 503, the first door flap 504, the second door flap 505, the door opening fasteners 506, the logo placement 508, and the assembled canopy cover 5100.

FIG. 23 is a detail view of the guide hole stop disc of the first or second exemplary embodiment, displaying the vertical support socket 2300, the vertical support socket fastener 2301, the stop disc 2302, and the insertion member 2303.

FIG. 24 is a detail view of the bracket of the first or second exemplary embodiment, displaying the bracket vertical support socket 2400, the bracket vertical support socket fastener 2401, the bracket vertical support tube 2402, the bracket flat 2403, the bracket fasteners 2404, and the secondary bracket flat 2405.

FIG. 25 is a detail view of the auger pole of the first or second exemplary embodiment, displaying the water body bed 106 (represented by an oblique line) the auger pole vertical support socket 2500, the auger pole vertical support fastener 2501, the auger pole 2502, and the auger 2503.

FIG. 26 is a detail view of the connection between the secondary vertical supports and the horizontal supports of the second exemplary embodiment, displaying the horizontal support 601, the secondary vertical support element 2600, secondary vertical support pin 2601, the horizontal support pinhole 2602, and the secondary vertical support access hole 2603.

FIG. 27 is a detail view of the pin connection of the secondary vertical supports of the second exemplary embodiment, displaying the secondary vertical support 2600, the secondary vertical support pin 2601, and the secondary vertical support pinhole 2700.

DETAILED DESCRIPTION OF THE INVENTION

Figure 1:
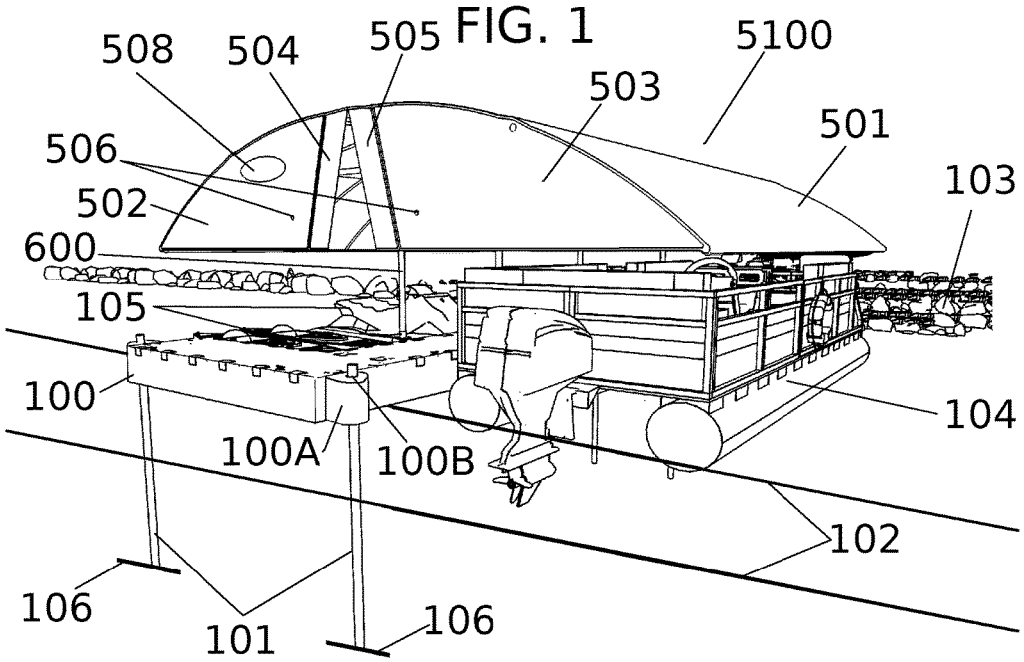
FIG. 1 is a front right perspective scene view of the first exemplary embodiment with the door flaps in the open configuration, displaying the dock 100, the dock guides 100A, the dock guide holes 100B, the floating dock guide poles 101, the water level 102 (represented by two parallel oblique lines), the shore 103, the large exemplary watercraft 104, the small exemplary watercraft 105, the water body bed 106 (represented by oblique lines located at the base of floating dock guide poles 101), the second canopy top element 501, the first canopy side elements 502, the second canopy side elements 503, the first door flap 504, the second door flap 505, the door opening fasteners 506, the logo placement 508, the assembled canopy cover 5100, and the vertical supports 600.
Figure 2:
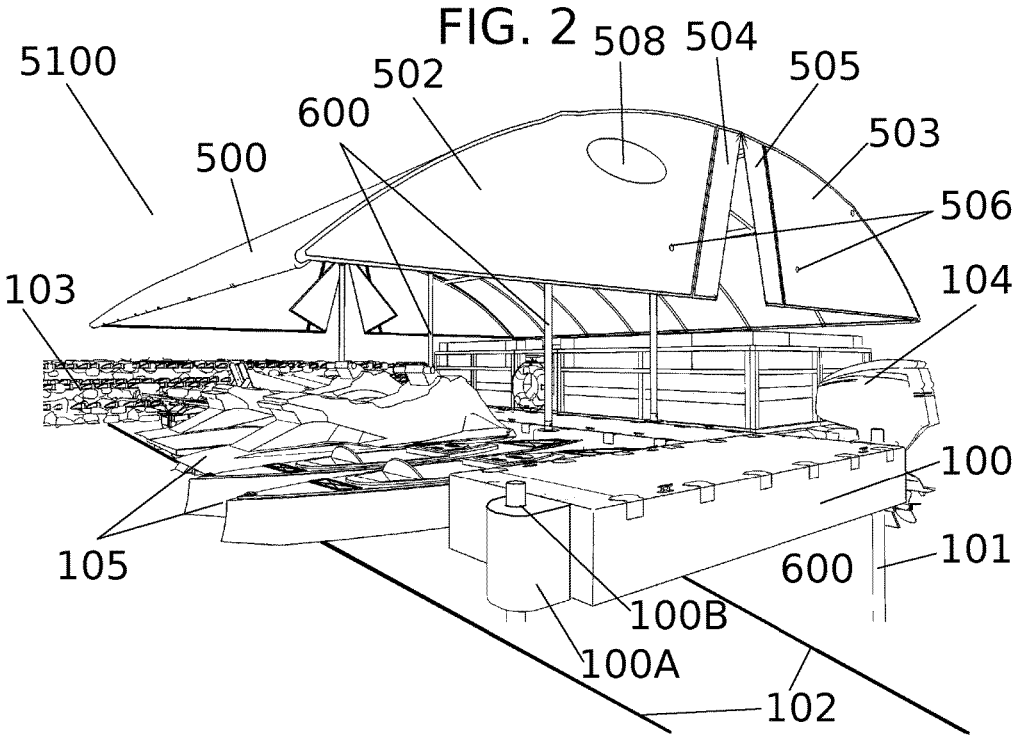
FIG. 2 is a front left perspective scene view of the first exemplary embodiment with the door flaps in the open configuration, displaying the dock 100, the dock guides 100A, the dock guide holes 100B, the floating dock guide poles 101, the water level 102 (represented by two parallel oblique lines), the shore 103, the large exemplary watercraft 104, the small exemplary watercraft 105, the first canopy top element 500, the first canopy side elements 502, the second canopy side elements 503, the first door flap 504, the second door flap 505, the door opening fasteners 506, the logo placement 508, the assembled canopy cover 5100, and the vertical supports 600.

Referring now to the invention in more detail, the invention is directed to a cantilevered watercraft canopy. As shown in FIGS. 1-4, the environment of the preferred environment is installation on a dock 100 or pier such that mooring areas on both sides of the dock 100 are covered by the canopy. As used herein, the term "watercraft mooring area" means an area that is filled with water suitable for the storing of watercraft that are floating in the water. The term "watercraft mooring area" is not contemplated by the Inventor to include an area on land used for storing watercraft. As depicted in FIGS. 1-4, defined within the environment are the water level 102 (the water level 102 is represented by a pair of parallel oblique lines, which define a plane within the perspective of the figures), the shore 103, and the water body bed 106 (the water body bed 106 is represented by short oblique line segments located at the base of the guide poles 101; the water body bed 106, of course, extends in all directions under the body of water in the locale of installation). In general the water body bed 106 may refer to the floor of any body of water in which the user wishes to moor watercraft—for example, a lake bed, riverbed, pond bed, seabed, etc., including the bed of an artificial body of water. While an aspect of the preferred embodiment, the presence of a dock 100 or even a body of water are not required to practice the invention, which may be installed over a mooring area having no walking access (for example, using the auger pole support option of FIG. 25), or over a location with no water at all. The invention may provide covered mooring for large exemplary watercraft 104, for example the pontoon boat shown, small exemplary watercraft 105, for example canoes, kayaks, or powered personal watercraft, as shown, or for any other type of watercraft moorable at a dock 100.

In the preferred embodiment, the dock 100 is a floating dock. Currently commercially available floating docks are characterized by a system of modular configurable dock guides 100A, which form a bracket attached to the outer edge of the floating dock 100. Each dock guide 100A is pierced by a floating dock guide hole 100B. Some commercially available floating docks dispense with the floating dock guide bracket in favor of piercing the dock with the guide hole directly; in this case, the invention is installed in the provided guide holes. In ordinary operation, floating dock guide poles 101 are augured to the water body bed 106 and configured to pass through the guide holes 100B just above the water level 102. The floating dock 100 is thus allowed to move freely up and down as the water level 102 changes over time, but is restricted in its horizontal motion by the guide poles 101.

In all embodiments, the present invention relies upon vertical supports 600, each having a bottom end 600A and a top end 600B. The vertical supports 600 are preferably affixed, at the bottom end 600A, to a mounting surface, generally either the dock 100 or the water body bed 106, by any of several provided vertical support mounting means for mounting the vertical supports to the mounting surface. In the preferred embodiment, where a floating dock 100 is present, the mounting surface is provided by adding extra dock guides 100A to the dock 100. The bottom end 600A of each vertical support is inserted into a vertical support socket 2300, which is secured by a vertical support socket fastener 2301 (for example, an installed Allen bolt, as shown). The vertical support socket 2300 is located at the top end of an insertion member 2303, which fits inside the guide hole 100B. Near its top, the insertion member 2303 is surrounded by and rigidly affixed to a rigid top disc 2302, which is larger in diameter than the guide hole 100B. Thus, the insertion member 2303 and stop disc 2302 together secure the vertical support 600 with the insertion member

2303 resting within the guide hole 100B and the stop disc 2302 resting above the guide hole 100B.

An alternative embodiment provides for attaching the vertical supports 600 to a fixed dock 100. In such a configuration, the bottom end 600A of each vertical support is inserted into a bracket vertical support socket 2400 and thence into a bracket vertical support tube 2402, where it is secured by a vertical support socket fastener 2401 (for example, an installed Allen bolt, as shown). The bracket vertical support tube is affixed to a bracket flat 2403, which is affixed to the side of the dock 100 by fastening through or around the dock edge to a secondary bracket flat 2405, forming a clamp. The vertical support fasteners 2404 may be hexagonal bolts, as shown, or generally any type of bolt, screw, or the like. Together, the bracket vertical support tube 2402, bracket vertical support socket 2400, bracket flat 2403, and secondary bracket flat 2405 form a bracket, and the vertical support 600 may be understood as being inserted into and affixed within the bracket.

Another alternative embodiment provides for attaching the vertical supports 600 to an auger pole 2502 via an auger pole vertical support socket 2500 where it is secured by a vertical support socket fastener 2501 (for example, an installed Allen bolt, as shown). The base of the auger pole 2502 is fitted with an auger 2503, which is driven into the water body bed 106. This allows the invention to be practiced in the absence of a suitably stable dock 100 and in the absence of any dock or pier at all, for example in an open water mooring area.

Referring now to the canopy frame 6100 of FIGS. 6-8, the vertical supports 600 support the canopy frame 6100. Preferably, the vertical supports 600 support the entire canopy frame 6100 alone—that is, without any non-vertical elements such as cross-bracing that would obstruct access to the walking space on the dock 100 or in watercraft mooring area on the water. Affixed to the top 600B of the vertical supports 600 are a number of horizontal supports 601, each having a first end 601A and a second end 601B. The horizontal supports 601 are preferably at equal height, parallel with one another, of equal length, and extend an equal distance from the dock 100. In the preferred embodiment, as shown, the vertical supports 600 form two rows in-line with either side of the dock 100, and the horizontal supports are oriented across opposing pairs of vertical supports 600, crosswise with the dock 100. Generally, each horizontal support is affixed to the top 600B of at least one vertical support 600, however, in the embodiment shown, the two opposing pairs of vertical supports 600 are present and two horizontal supports 601 are correspondingly present, though the entire apparatus may be extended over longer docks 100 by adding additional horizontal supports 601 and opposing pairs of vertical supports 600. Attached to all of the first ends 601A of the horizontal supports 601 is a first main strut 602, and attached to all of the second ends 601B of the horizontal supports 601 is a second main strut 603. Depending upon the embodiment, the main struts 602 and 603 may be affixed rigidly or rotatably to the horizontal supports 601. In the preferred embodiment, and as shown, the main struts 602 and 603 are long relative to the distance between the opposing pairs of vertical supports (about the width of the dock 100) such that the main struts 602 and 603 are parallel to one another, horizontal, and substantially distal to the vertical supports 600 to a length sufficient to extend over target watercraft such as the large exemplary watercraft 104, moored width-wise, as shown, or the small exemplary watercraft, moored lengthwise, as shown.

Referring still to the canopy frame 6100 of FIGS. 6-8, a set of first arch members 604 and a set of second arch members 605 are provided. Each set of arch members 604 and 605 provides sufficient arc to cover about half of the total intended arc of the canopy frame 6100. For both the first and second exemplary embodiment the canopy frame 6100 may be understood as defining a barrel vault that is open and unobstructed at either end, as shown in FIGS. 6-7; the barrel vault thereby provides unobstructed and enclosed access to watercraft moored in the mooring area. The ends of the barrel vault may be understood as defining the longitudinal direction of the barrel vault, with the perpendicular and horizontal direction (i.e., the direction of the horizontal supports 601) may be understood as defining the transverse direction of barrel vault, as illustrated in FIG. 6. As understood from the figure, the total arc of the canopy frame 6100 is intended to be substantially less than 180° of a circle that is oriented in a vertical plane orthogonal to the dock 100 whose radius is substantially larger than the height of the canopy frame 6100. Accordingly, as used herein, the "end" of a barrel vault is defined as that portion of a vertical plane aligned to the longitudinally most distal pair of arch members 604 and 605 that is enclosed by the longitudinally most distal pair of arch members themselves, a line segment and/or chord connecting their outer ends 604C and 605C together, and, for embodiments where the two are not directly connected, a segment of arc connecting their inner ends 604A and 605A together. Thus, where, as stated above, the "barrel vault [ . . . ] is open and unobstructed at either end", the meaning is that the ends, as defined, are not intersected by any support or cross bracing, as shown in FIGS. 6-7. Alternative embodiments, of course, may provide a different roof shape, for example that of a pair of angled awnings or a rectangular or irregular roof shape defined by the arch members 604 and 605 not conforming to sections of arc. In such embodiments, the terms "longitudinal" and "transverse" may be understood relative to the particular roof shape. Each of the first arch members 604 has defined an inner end 604A, a central attachment point 604B, and an outer end 604C. Each of the second arch members 605 has defined an inner end 605A, a central attachment point 605B, and an outer end 605C. The first arch members 604 are affixed, at their central attachment points 604B, to the first main strut 602. The second arch members 605 are affixed, at their central attachment points 605B, to the second main strut 603. All of the first arch members 604 are of equal length (both linear length and arc length), oriented such that they are parallel to one another, perpendicular (at the point of attachment) to the first main strut 602, and arched inward or downward with respect to the first main strut 602. All of the second arch members 605 are oriented such that they are of equal length (both linear length and arc length), parallel to one another, perpendicular (at the point of attachment) to the second main strut 603, and arched inward or downward with respect to the first main strut 603.

Referring still to the canopy frame 6100 of FIGS. 6-8, a first outer strut 606 and a second outer strut 607 are provided. The first outer strut is affixed to all of the outer ends 604C of the first arch members 604. The second outer strut 607 is affixed to all of the outer ends 605C of the second arch members 605. Thus, in its most generic form, the canopy frame 6100 may be understood as comprising the first arch members 604, the second arch members 605, the first main strut 602, the second main strut 603, the first outer strut 606, the second outer strut 606, and the horizontal supports 601. Generically, the canopy frame 6100 is substantially covered by a canopy cover 5100 affixed thereto, which may be as described below or may be any fabric covering according to methods and principles well known in the art. The outer struts 606 and 607 hang at a height defining the bottom of the canopy, which is preferably at a level at which the target watercraft, such as the large exemplary watercraft 104 of the figures, can just pass under the canopy without colliding. This permits the user to moor watercraft uncovered beneath the canopy without risking damage to the watercraft from the elements.

In the first exemplary embodiment of FIG. 6, the first main strut 602 and second main strut 603 are rigidly affixed to the horizontal supports 601 such that they do not rotate. Further, each of the first arch members 604 is joined at its inner end 604A to the inner end 605A of one of the second arch members 605, and vice versa such that each of the second arch members 605 is also joined to a first arch member 604 with no extra arch members 604 or 605. Equivalently, it is understood that there are equal numbers of arch members 604 and 605, and each is aligned with a corresponding one of the other. In the first exemplary embodiment, the inner ends 604A and 605A of the first arch members 604 and second arch members 605 is achieved with a central arch connection 608, which may be of any joining fastener type but is preferably of the straight connector 1600 type discussed below.

In the second exemplary embodiment of FIGS. 7-8, the first main strut 602 and second main strut 603 are rotatably affixed to the horizontal supports 601 such that they can turn, at least somewhat freely (substantial friction allowing the main struts 602 and 603 to retain their rotational position unless pushed or pulled by hand is preferable) while connected to the horizontal supports 601. The rotatable connection is minimally required during installation and striking of the canopy frame 6100, but may persist throughout the use of the canopy frame 6100. In the second exemplary embodiment, the arch members 604 and 605 are preferably weight-balanced about the main struts 602 and 603 such that they function as their own counterweights, rendering rotation of the main struts 602 and 603 easily done by hand. Further, a first inner strut 700 and a second inner strut 701 are provided. The first inner strut is affixed to all of the inner ends 604A of the first arch members 604. The second inner strut is affixed to all of the inner ends 605A of the second arch members 605. When placed in the use configuration of FIG. 7, the inner struts 700 and 701 are positioned proximate to one another and directly overhead of the dock 100, as shown. In the use configuration, the first inner strut 700 is secured to each horizontal support 601 by a set of first secondary vertical supports 702. Each first secondary vertical support 702 is removably affixed at its bottom end 702A to one of the horizontal supports 601 and at its top end 702B to the first inner strut 700. Similarly, in the use configuration, the second inner strut 701 is secured to each horizontal support 601 by a set of second secondary vertical supports 703. Each second secondary vertical support 703 is removably affixed at its bottom end 703A to one of the horizontal supports 601 and at its top end 703B to the second inner strut 701. The connection between the secondary vertical supports 702 and 703 (either is represented as reference number 2600 in FIGS. 26-27) and the horizontal supports 601 is made by a secondary vertical support pin 2601, which penetrates a collinear horizontal support pinhole 2602 and a secondary vertical support pinhole 2700. The joint is achieved by inserting the secondary vertical support element 2600 into the secondary vertical support access hole 2603 in the top surface of the horizontal support 601. The second exemplary embodiment is thus advantaged because the rotation of the main struts 602 and 603 between the installation configuration of FIG. 8 and the use configuration of FIG. 7 permits the invention to be installed from the dock 100 without the need to stand on a watercraft or in the water.

In both the first and second exemplary embodiments, connections between the elements of the canopy frame 6100 may be achieved by any known means, and the elements of the canopy frame 6100 may be of any material or shape profile. However, in the preferred embodiment, the structural elements, specifically the vertical supports 600, the horizontal supports 601, the first main strut 602, the second main strut 603, the first arch members 604, the second arch members 605, the first outer strut 606, the second outer strut 607 and, in the second exemplary embodiment, the first inner strut 700, second inner strut 701, first secondary vertical supports 702, and second secondary vertical supports 703 are all made of galvanized steel pipe or beam, or alternative materials such as aluminum, composite, plastic, or wood. The frame elements may be manufactured to length or, preferably, are assembled from short modular segments having male and female connectors such that the entire frame is easily transported, assembled, and stored. Those frame elements that are hollow are preferably pierced with weep holes providing for the drainage and evaporation of internally accumulated moisture.

Figure 16:
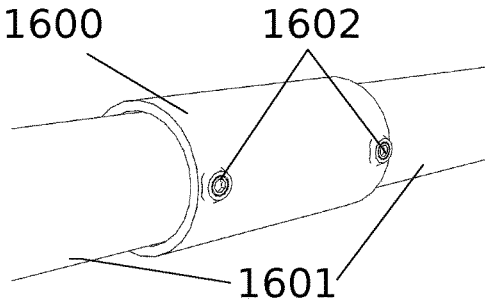
FIG. 16 is a detail view of the straight connector of the canopy frame elements of the first or second exemplary embodiment, displaying the straight connector 1600, the frame elements 1601, and the frame connector fasteners 1602.
Figure 17:
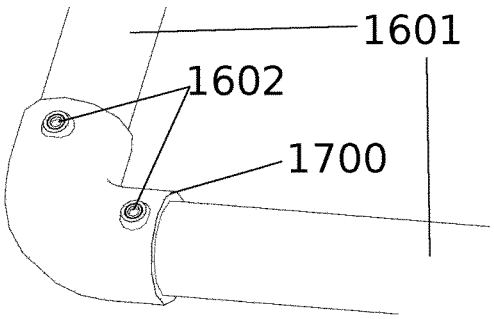
FIG. 17 a detail view of the right angle connector of the canopy frame elements of the first or second exemplary embodiment, displaying the frame elements 1601, the frame connector fasteners 1602, and the right angle connector 1700.
Figure 18:
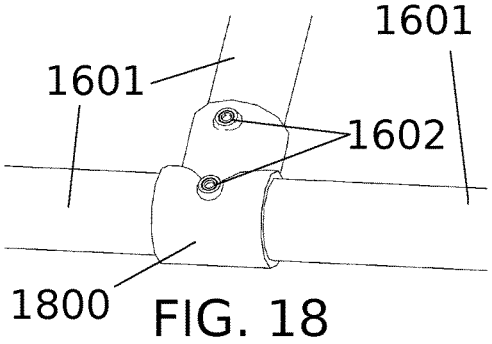
FIG. 18 is a detail view of the T-connector of the canopy frame elements of the first or second exemplary embodiment, displaying the frame elements 1601, the frame connector fasteners 1602, and the T-connector 1800.
Figure 19:
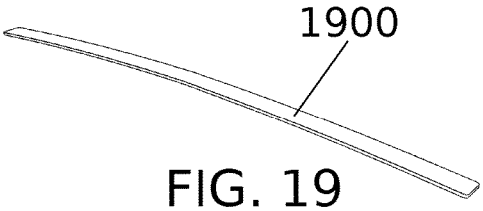
FIG. 19 is a detail view of the reinforcement element of the canopy cover of the first or second exemplary embodiment, displaying the reinforcement element 1900.

The connections between the structural components are preferably formed with the pipe or beam connectors of FIGS. 16-18. A straight connector 1600 may join two inline frame elements 1601 and secure each with a frame connector fastener 1602. Similarly, a right-angle connector 1700 may join two frame elements 1601 and secure them via the same frame connector fastener 1602. Similarly, a T-connector 1800 may join two or three (with a central joint) frame elements 1601 and secure them via the same frame connector fastener 1602. The frame connector fastener 1602 preferably is formed from a welded nut within the frame connector 1600, 1700, or 1800 that is threaded with an Allen bolt. The same size Allen bolt is preferably used in the vertical support socket fastener 2301, the bracket vertical support socket fastener 2401, and the auger pole vertical support socket fastener 2501, and any other bolt connections such that the entire frame may be assembled and stricken with a single tool: the one Allen wrench of the particular size chosen. Referring still to the frame connectors 1600, 1700, and 1800, the Applicant has identified and applied commercially available Kee Klamp® brand connectors with success in the context of the present invention.

Figure 3:
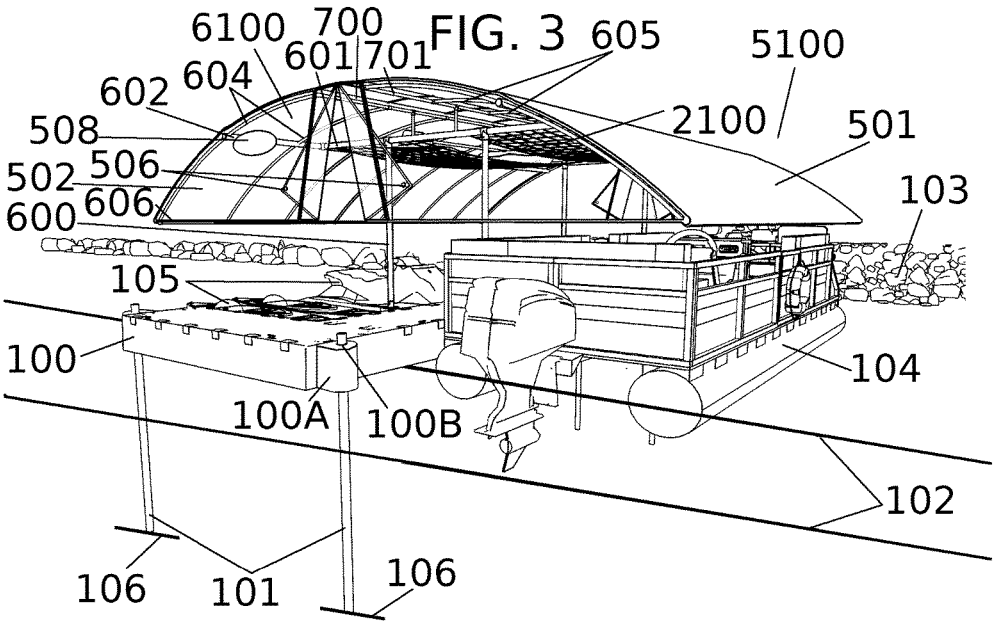
FIG. 3 is a front right perspective scene view of the second exemplary embodiment with transparent canopy elements and with the door flaps in the open configuration, displaying the dock 100, the dock guides 100A, the dock guide holes 100B, the floating dock guide poles 101, the water level 102 (represented by two parallel oblique lines), the shore 103, the large exemplary watercraft 104, the small exemplary watercraft 105, the water body bed 106 (represented by oblique lines located at the base of floating dock guide poles 101), the second canopy top element 501, the first canopy side elements 502 (transparent), the second canopy side elements 503 (transparent), the first door flap 504 (transparent), the second door flap 505 (transparent), the door opening fasteners 506, the logo placement 508, the assembled canopy cover 5100, the vertical supports 600, the horizontal supports 601, the first main strut 602, the first arch members 604, the second arch members 605, the first outer strut 606, the assembled canopy frame 6100, the first inner strut 700, the second inner strut 701, the first secondary vertical supports 702, and the second secondary vertical supports 703.
Figure 4:
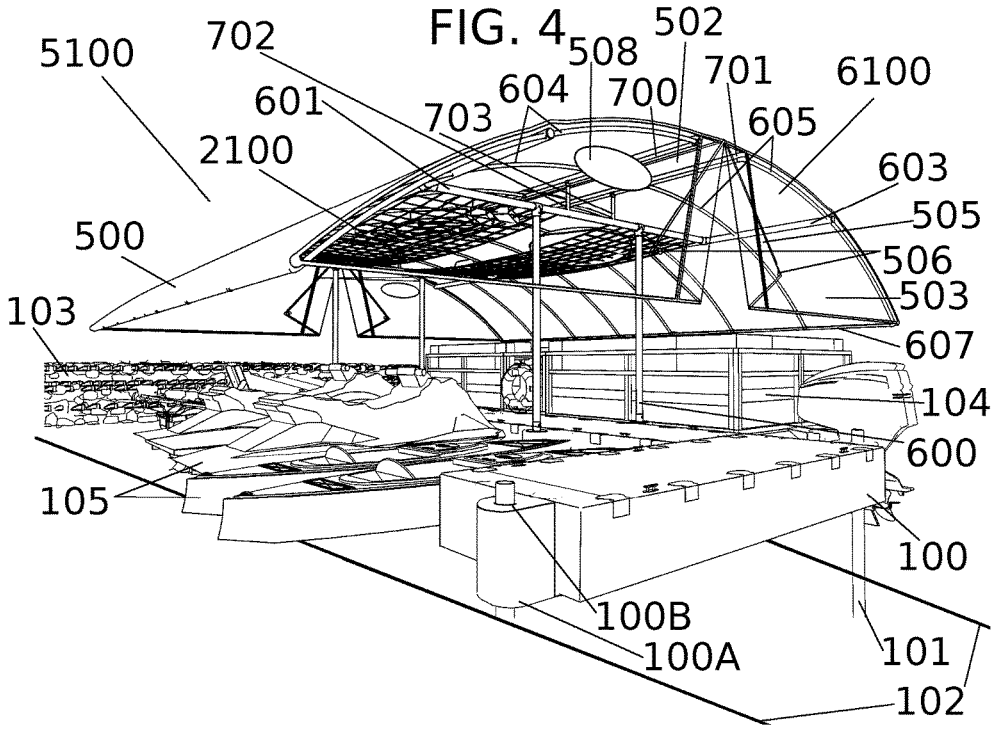
FIG. 4 is a front left perspective scene view of the second exemplary embodiment with transparent canopy elements and with the door flaps in the open configuration, displaying the dock 100, the dock guides 100A, the dock guide holes 100B, the floating dock guide poles 101, the water level 102 (represented by two parallel oblique lines), the shore 103, the large exemplary watercraft 104, the small exemplary watercraft 105, the first canopy top element 500, the first canopy side elements 502 (transparent), the second canopy side elements 503 (transparent), the first door flap 504 (transparent), the second door flap 505 (transparent), the door opening fasteners 506, the logo placement 508, the assembled canopy cover 5100, the vertical supports 600, the horizontal supports 601, the second main strut 603, the first arch members 604, the second arch members 605, the second outer strut 607, the assembled canopy frame 6100, the first inner strut 700, the second inner strut 701, the first secondary vertical supports 702, and the second secondary vertical supports 703.
Figure 22:
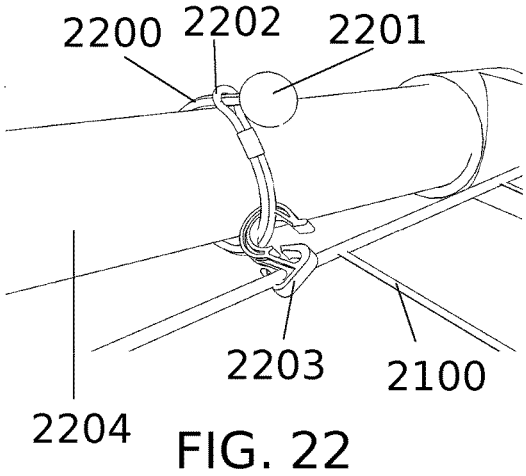
FIG. 22 is a detail view of the net element fasteners of the first or second exemplary embodiment, displaying the storage net 2100, the net cord 2200, the net cord loop 2202, the net cord ball 2201, the double hook 2203, and the net supporting frame element 2204.
Figure 28:
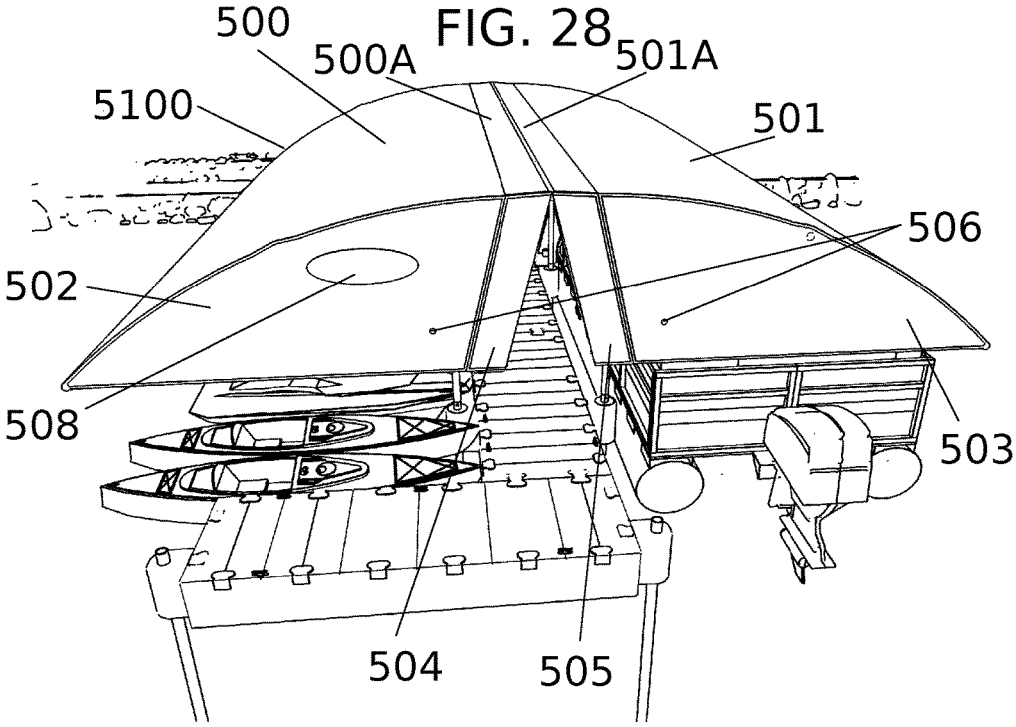
FIG. 28 is a front elevated scene view of the first exemplary embodiment with the door flaps in the open configuration, displaying the first canopy top element 500, the first canopy inner top element 500A, the second canopy top element 501, the second canopy inner top element 501A, the first canopy side elements 502, the second canopy side elements 503, the first door flap 504, the second door flap 505, the door opening fasteners 506, the logo placement 508, and the assembled canopy cover 5100.
Figure 29:
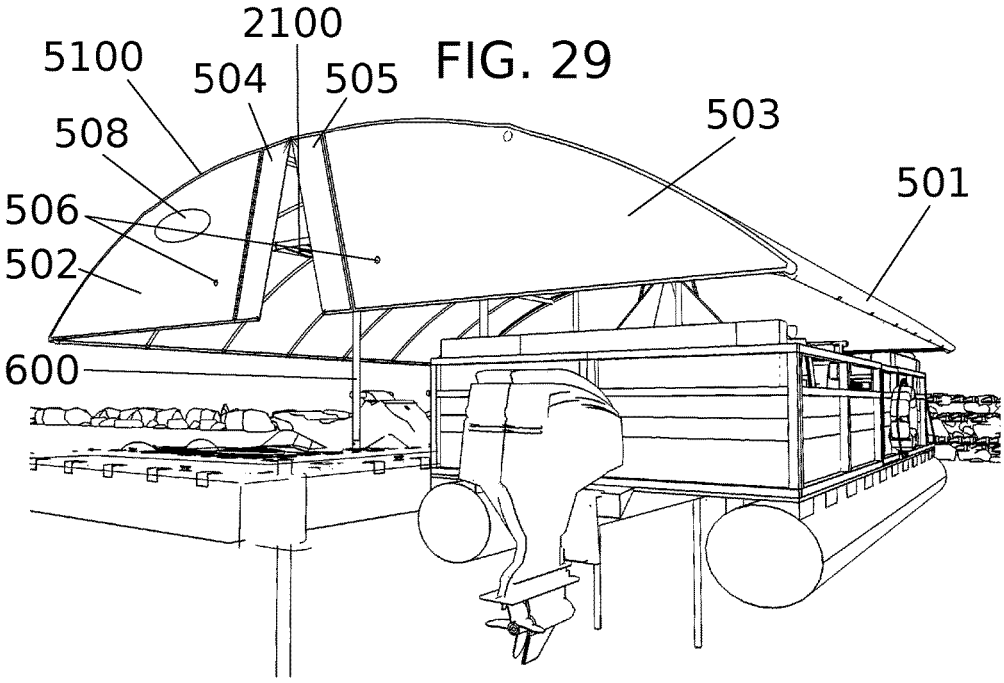
FIG. 29 is a lowered right perspective scene view of the first exemplary embodiment with the door flaps in the open configuration, displaying the second canopy top element 501, the first canopy side elements 502, the second canopy side elements 503, the first door flap 504, the second door flap 505, the door opening fasteners 506, the logo placement 508, the assembled canopy cover 5100, the vertical supports 600, and the storage netting 2100.
Figure 30:
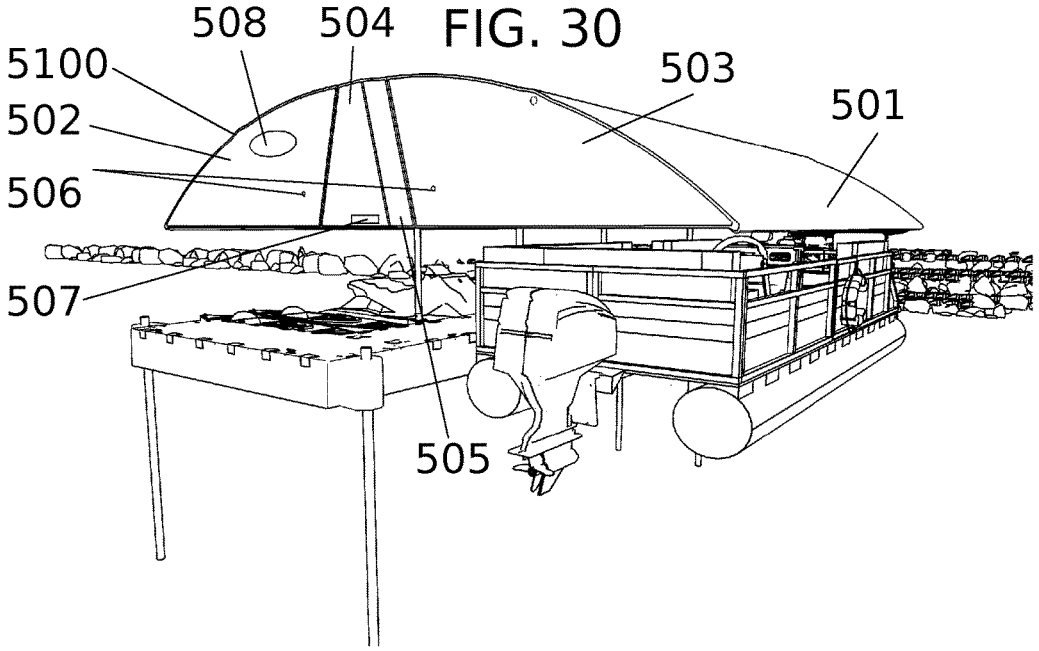
FIG. 30 a is a front right perspective scene view of the first exemplary embodiment with the door flaps in the closed configuration, displaying the second canopy top element 501, the first canopy side elements 502, the second canopy side elements 503, the first door flap 504, the second door flap 505, the door opening fasteners 506, the door closing fastener 507, the logo placement 508, and the assembled canopy cover 5100.
Figure 31:
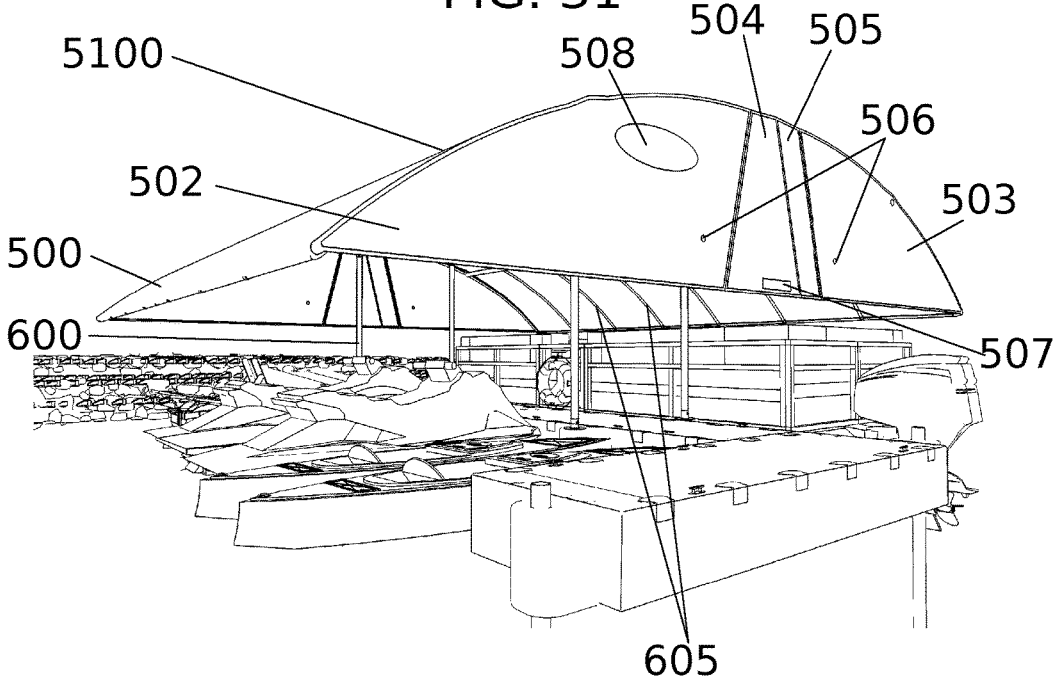
FIG. 31 is a front left perspective scene view of the first exemplary embodiment with the door flaps in the closed configuration, displaying the first canopy top element 500, the first canopy side elements 502, the second canopy side elements 503, the first door flap 504, the second door flap 505, the door opening fasteners 506, the door closing fastener 507, the logo placement 508, the assembled canopy cover 5100, the vertical supports 600, and the second arch member 605.
Figure 32:
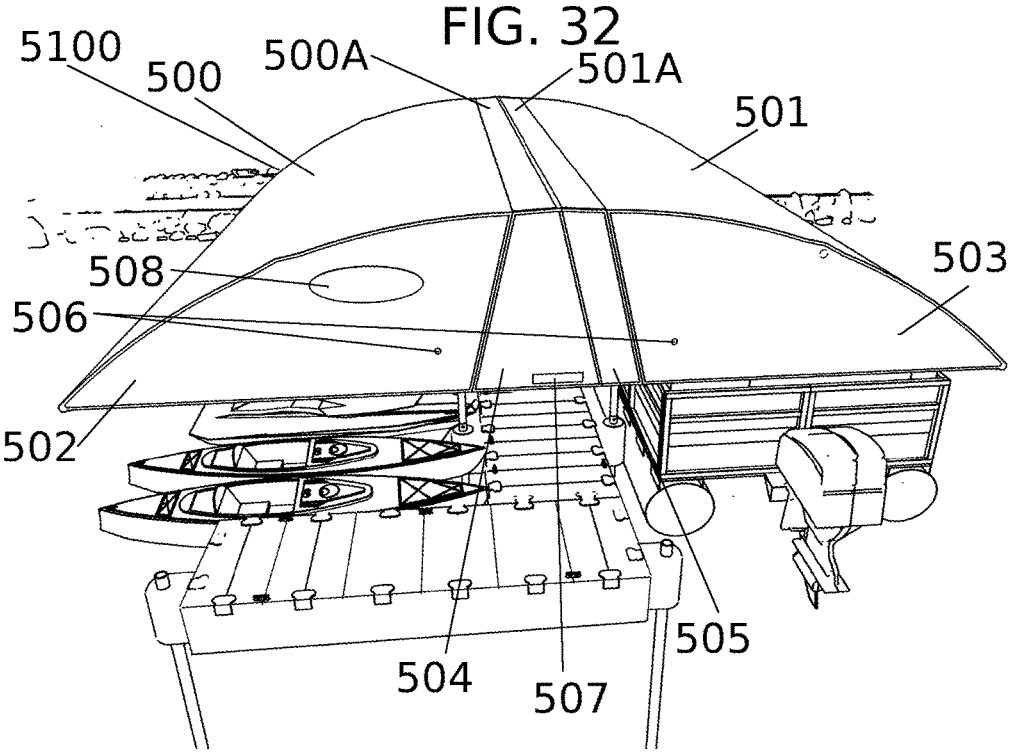
FIG. 32 is a front elevated scene view of the first exemplary embodiment with the door flaps in the closed configuration, displaying the first canopy top element 500, the first canopy inner top element 500A, the second canopy top element 501, the second canopy inner top element 501A, the first canopy side elements 502, the second canopy side elements 503, the first door flap 504, the second door flap 505, the door opening fasteners 506, the door closing fastener 507, the logo placement 508, and the assembled canopy cover 5100
Figure 33:
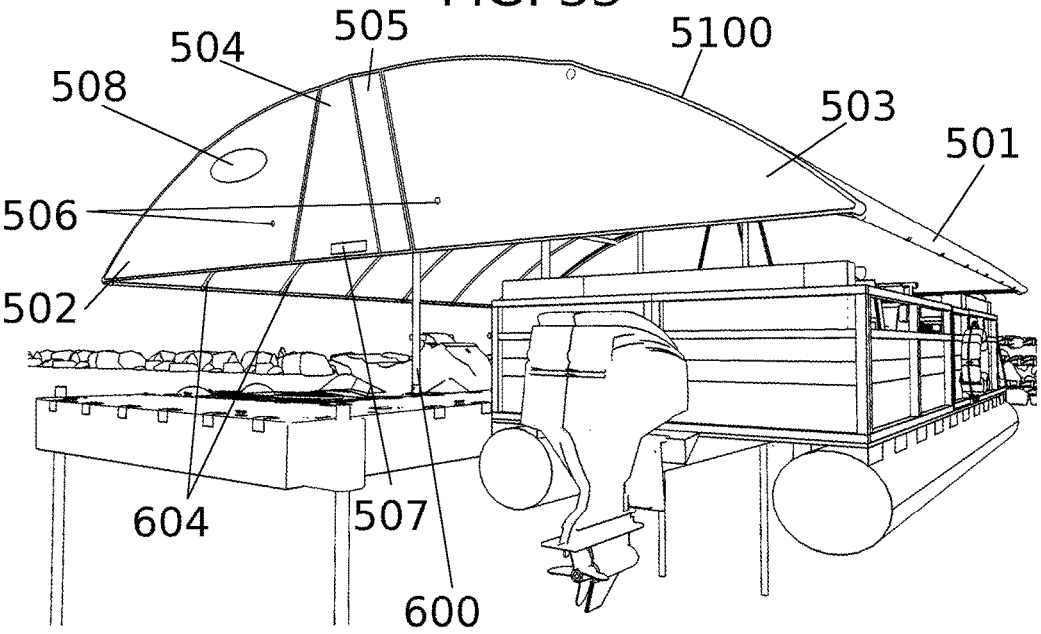
FIG. 33 is a lowered right perspective scene view of the first exemplary embodiment with the door flaps in the closed configuration, displaying the second canopy top element 501, the first canopy side elements 502, the second canopy side elements 503, the first door flap 504, the second door flap 505, the door opening fasteners 506, the door closing fastener 507, the logo placement 508, and the assembled canopy cover 5100, the vertical supports 600, and first arch members 604.
Figure 34:
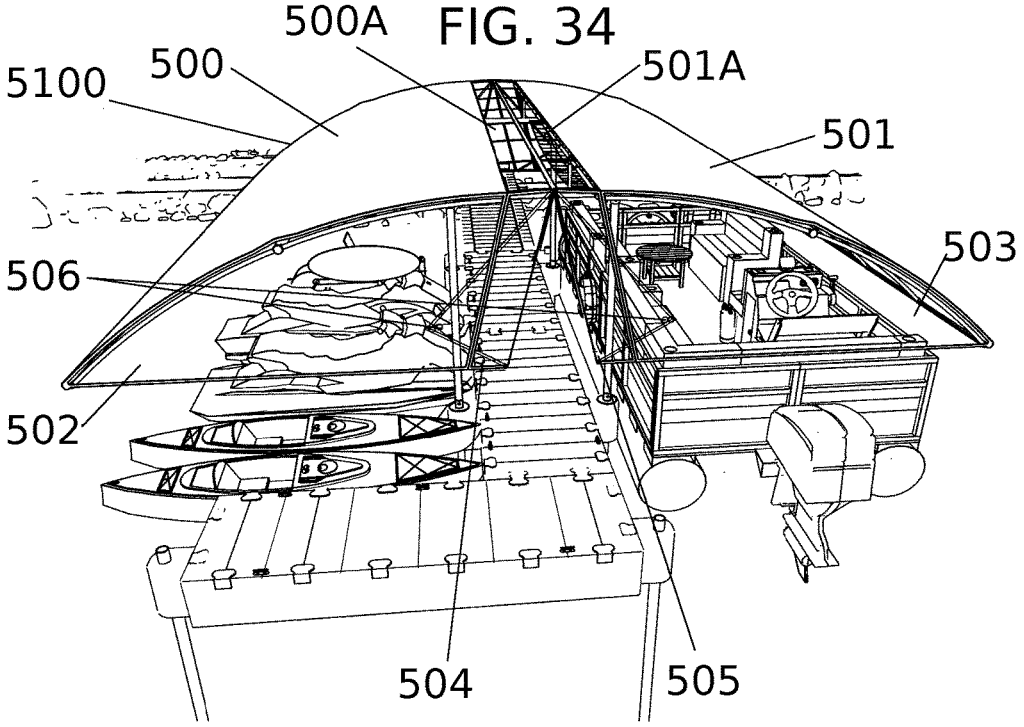
FIG. 34 is a front elevated scene view of the second exemplary embodiment with transparent canopy elements and with the door flaps in the open configuration, displaying the first canopy top element 500, the first canopy inner top element 500A (transparent), the second canopy top element 501, the second canopy inner top element 501A (transparent), the first canopy side elements 502 (transparent), the second canopy side elements 503 (transparent), the first door flap 504 (transparent), the second door flap 505 (transparent), the door opening fasteners 506, the logo placement 508, and the assembled canopy cover 5100.
Figure 35:
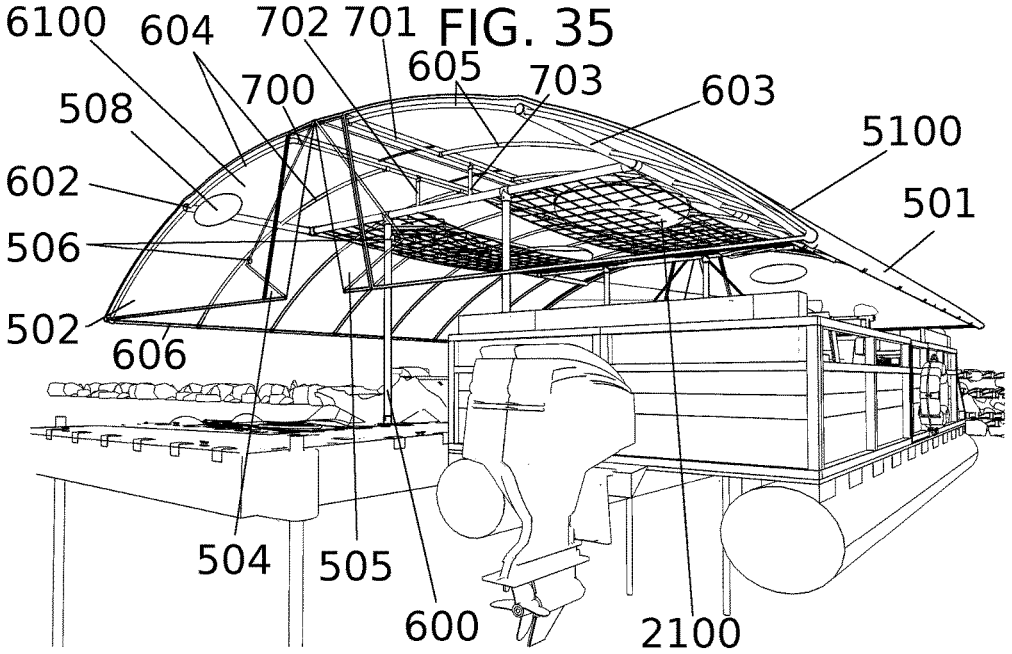
FIG. 35 is a lowered right perspective scene view of the second exemplary embodiment with transparent canopy elements and the door flaps in the open configuration, displaying the second canopy top element 501, the first canopy side elements 502 (transparent), the second canopy side elements 503 (transparent), the first door flap 504 (transparent), the second door flap 505 (transparent), the door opening fasteners 506, the logo placement 508, the assembled canopy cover 5100, the vertical supports 600, the horizontal supports 601, the first main strut 602, the second main strut 603, the first arch members 604, the second arch members 605, the first outer strut 606, the assembled canopy frame 6100, the first inner strut 700, the second inner strut 701, the first secondary vertical supports 702, the second secondary vertical supports 703, and the storage netting 2100.
Figure 36:
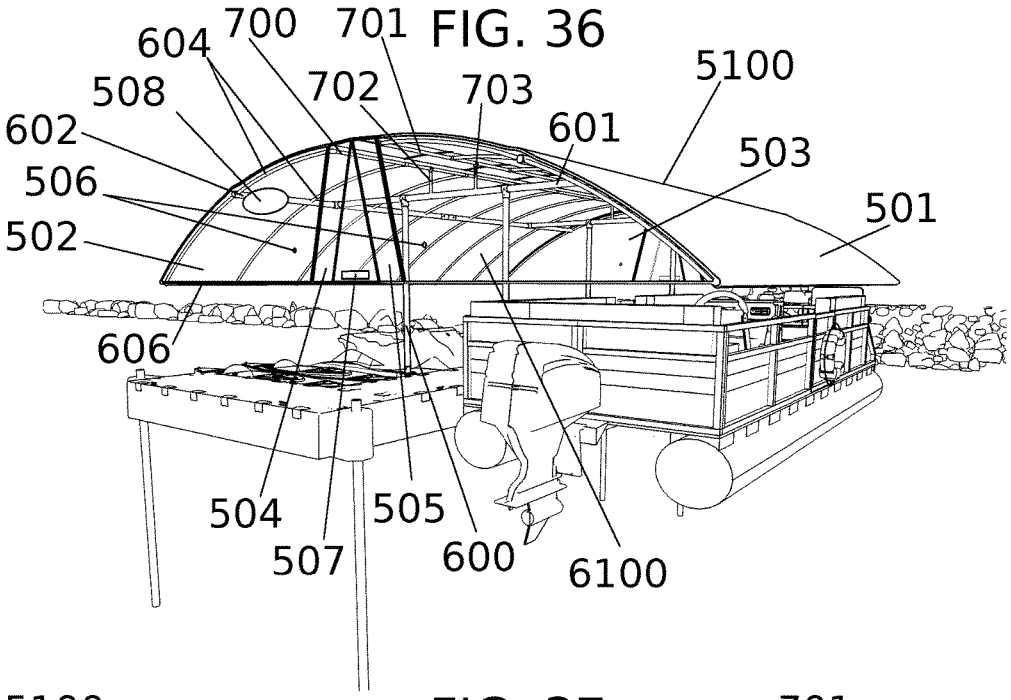
FIG. 36 is a front right perspective scene view of the second exemplary embodiment with transparent canopy elements and with the door flaps in the closed configuration, displaying the second canopy top element 501, the first canopy side elements 502 (transparent), the second canopy side elements 503 (transparent), the first door flap 504 (transparent), the second door flap 505 (transparent), the door opening fasteners 506, the door closing fastener 507, the logo placement 508, the assembled canopy cover 5100, the vertical supports 600, the horizontal supports 601, the first main strut 602, the first arch members 604, the first outer strut 606, the assembled canopy frame 6100, the first inner strut 700, the second inner strut 701, the first secondary vertical supports 702, and the second secondary vertical supports 703.
Figure 37:
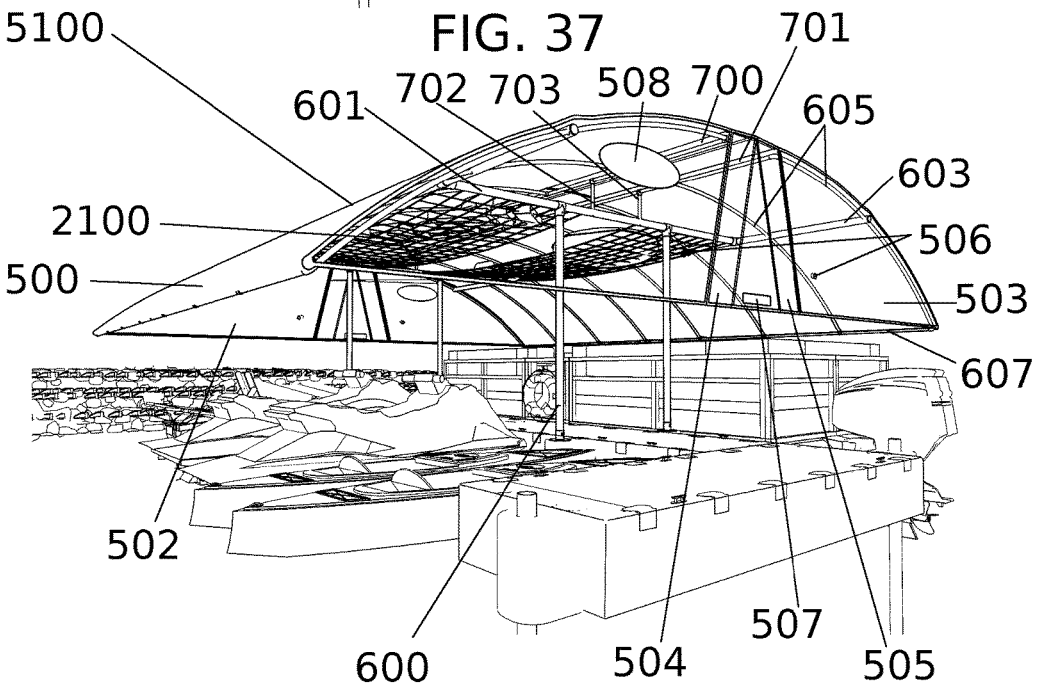
FIG. 37 is a front left perspective scene view of the second exemplary embodiment with transparent canopy elements and with the door flaps in the closed configuration, displaying the first canopy top element 500, the first canopy side elements 502 (transparent), the second canopy side elements 503 (transparent), the first door flap 504 (transparent), the second door flap 505 (transparent), the door opening fasteners 506, the logo placement 508, the assembled canopy cover 5100, the vertical supports 600, the horizontal supports 601, the second main strut 603, the second arch members 605, the second outer strut 607, the first inner strut 700, the second inner strut 701, the first secondary vertical supports 702, the second secondary vertical supports 703, and the storage netting 2100.
Figure 38:
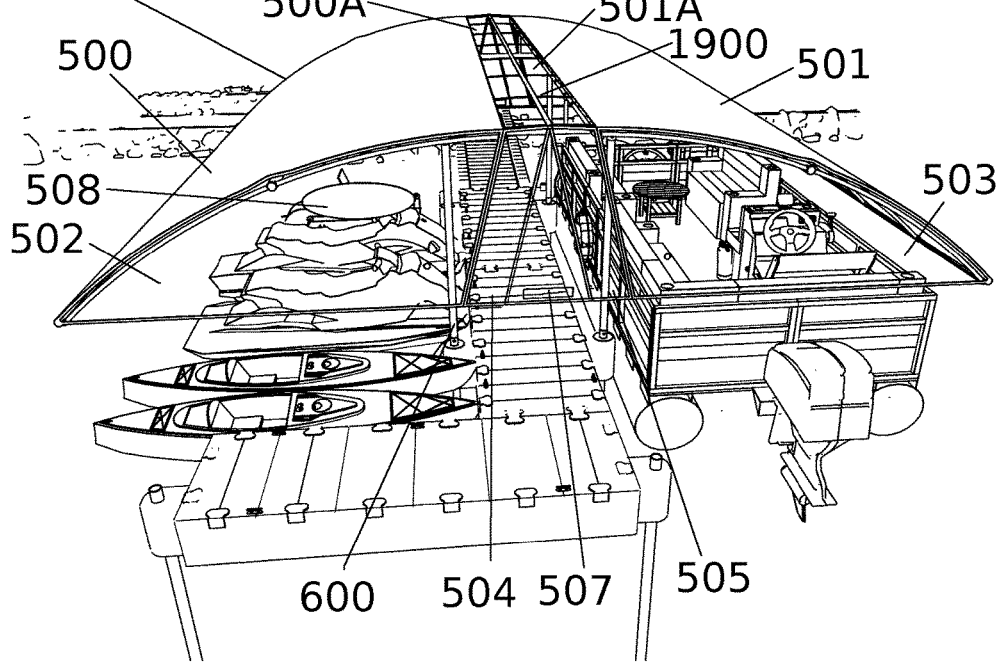
FIG. 38 is a front elevated scene view of the second exemplary embodiment with transparent canopy elements and with the door flaps in the closed configuration, displaying the first canopy top element 500, the first canopy inner top element 500A (transparent), the second canopy top element 501, the second canopy inner top element 501A (transparent), the first canopy side elements 502 (transparent), the second canopy side elements 503 (transparent), the first door flap 504 (transparent), the second door flap 505 (transparent), the door closing fasteners 507, the logo placement 508, the assembled canopy cover 5100, the vertical supports 600, and the reinforcement element 1900.
Figure 39:
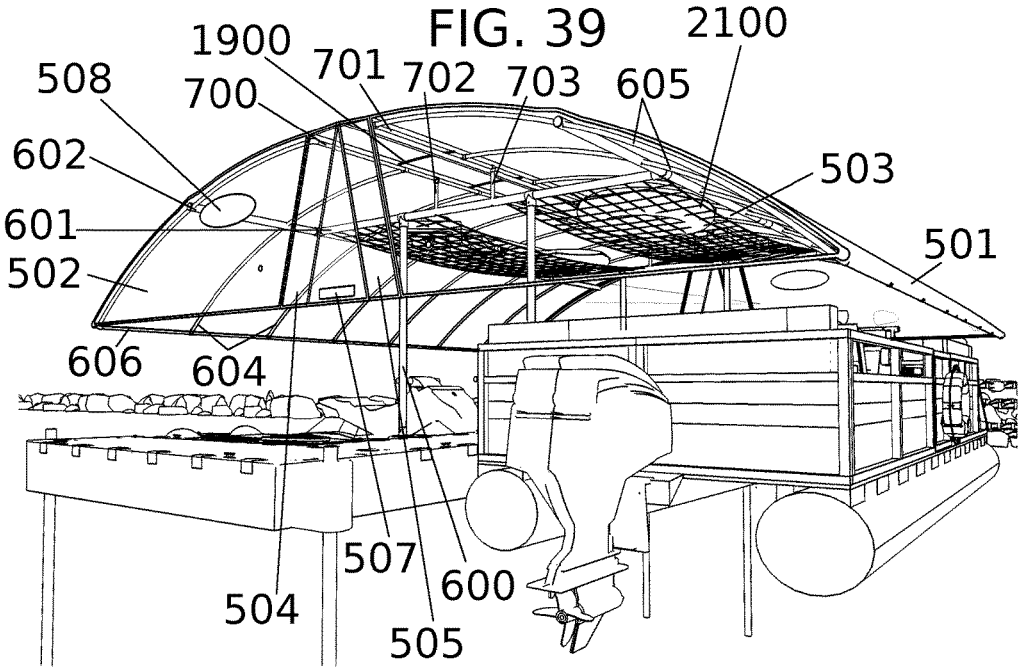
FIG. 39 is a lowered right perspective scene view of the second exemplary embodiment with transparent canopy elements and with the door flaps in the closed configuration, displaying the second canopy top element 501, the first canopy side elements 502 (transparent), the second canopy side elements 503 (transparent), the first door flap 504 (transparent), the second door flap 505 (transparent), the door closing fasteners 507, the logo placement 508, the assembled canopy cover 5100, the vertical supports 600, the horizontal supports 601, the first main strut 602, the first arch members 604, the second arch members 605, the first outer strut 606, the first inner strut 700, the second inner strut 701, the first secondary vertical supports 702, the second secondary vertical supports 703, the reinforcement element 1900, and the storage netting 2100.
Figure 40:
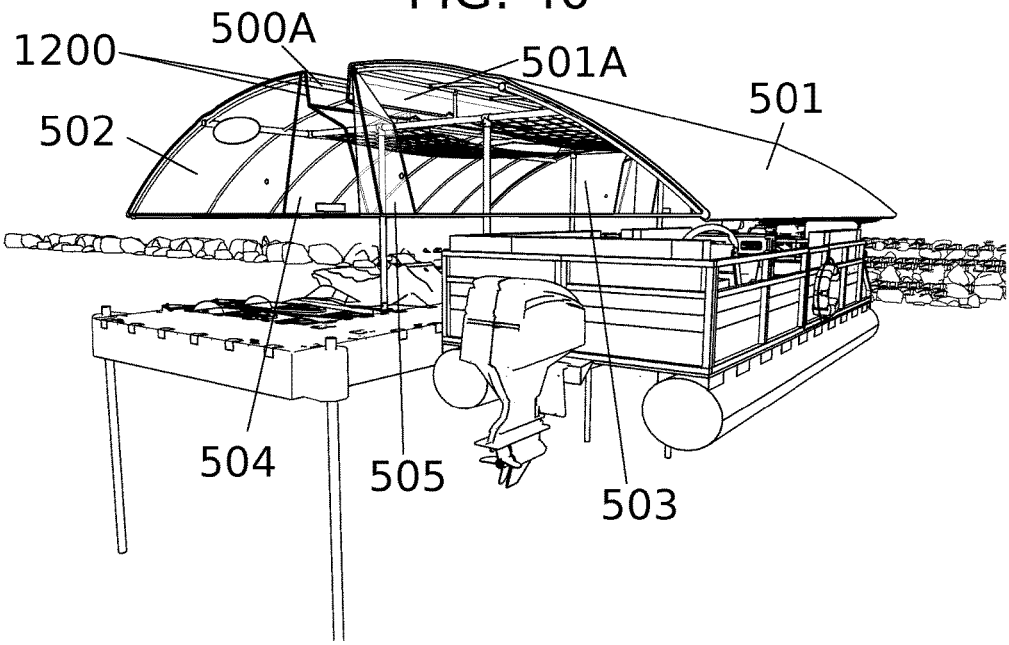
FIG. 40 is a front right perspective scene view of the second exemplary embodiment with transparent canopy elements and with the door flaps in the first installation configuration, displaying the first canopy inner top element 500A (transparent), the second canopy top element 501, the second canopy inner top element 501A (transparent), the first canopy side elements 502 (transparent), the second canopy side elements 503 (transparent), the first door flap 504 (transparent), the second door flap 505 (transparent), and the canopy fold 1200.
Figure 41:
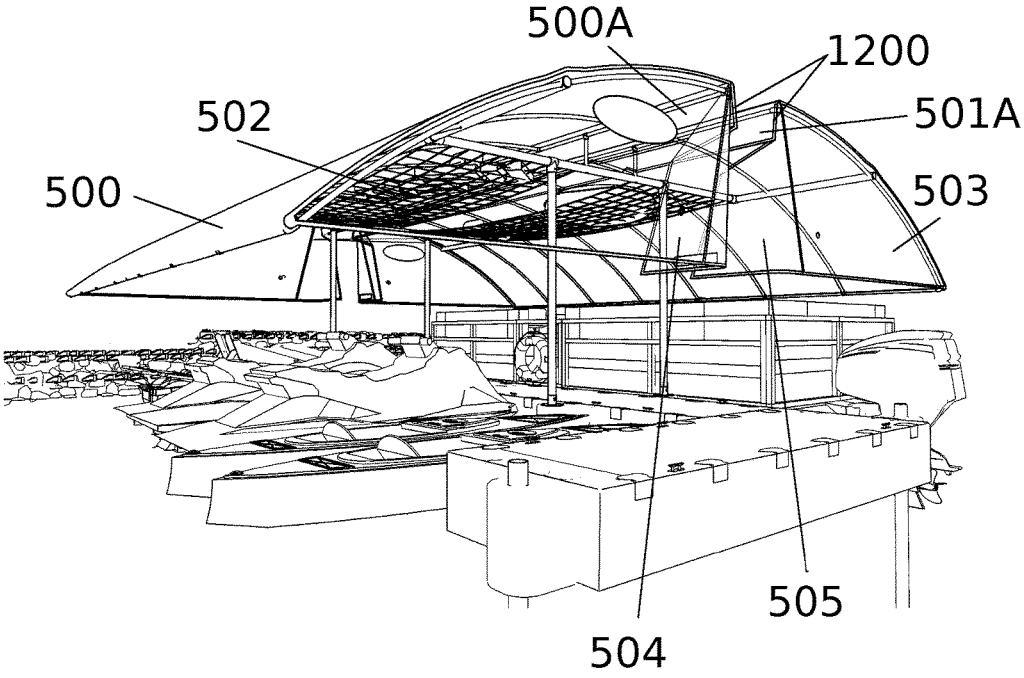
FIG. 41 is a front left perspective scene view of the second exemplary embodiment with transparent canopy elements and with the door flaps in the first installation configuration, displaying the first canopy top element 500, the first canopy inner top element 500A (transparent), the second canopy inner top element 501A (transparent), the first canopy side elements 502 (transparent), the second canopy side elements 503 (transparent), the first door flap 504 (transparent), the second door flap 505 (transparent), and the canopy fold 1200.
Figure 42:
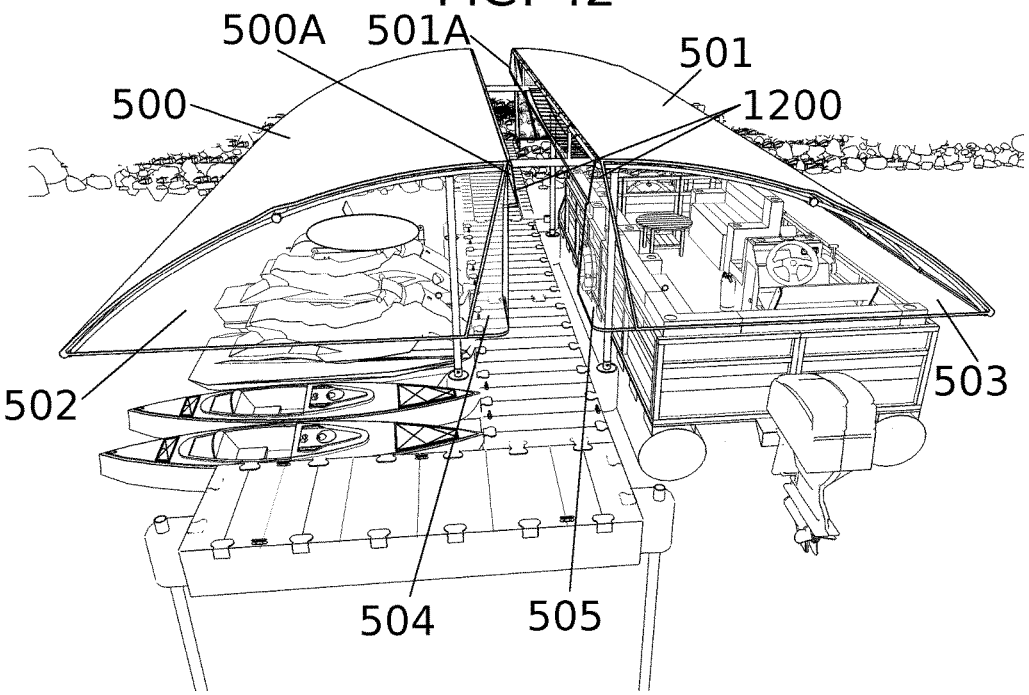
FIG. 42 is a front elevated scene view of the second exemplary embodiment with transparent canopy elements and with the door flaps in the first installation configuration, displaying the first canopy top element 500, the first canopy inner top element 500A (transparent), the second canopy top element 501, the second canopy inner top element 501A (transparent), the first canopy side elements 502 (transparent), the second canopy side elements 503 (transparent), the first door flap 504 (transparent), the second door flap 505 (transparent), and the canopy fold 1200.
Figure 43:
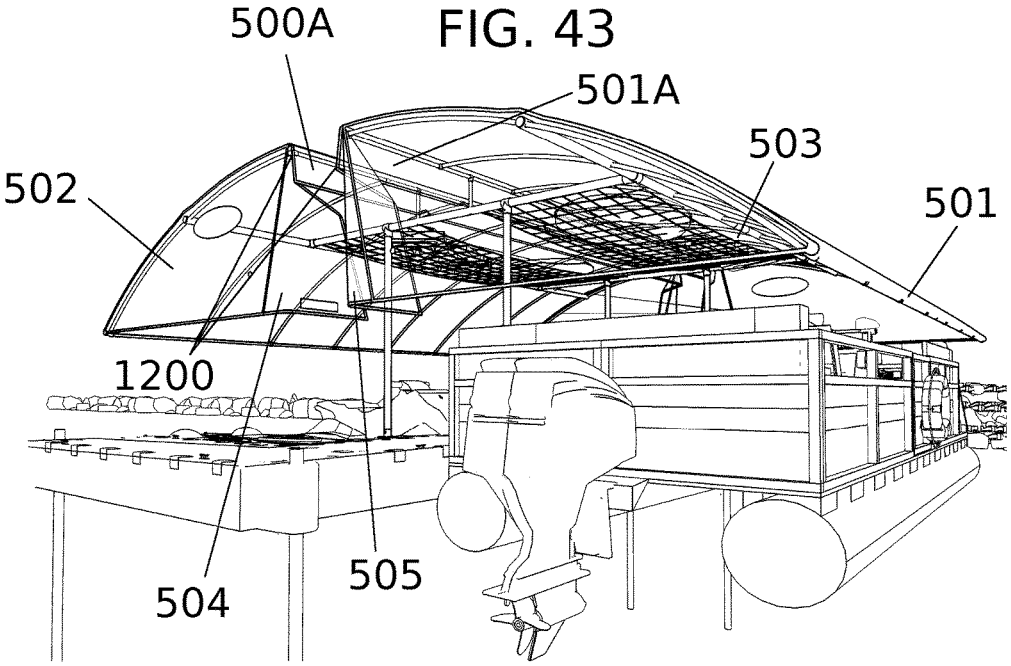
FIG. 43 is a lowered right perspective scene view of the second exemplary embodiment with transparent canopy elements and with the door flaps in the first installation configuration, displaying the first canopy inner top element 500A (transparent), the second canopy top element 501, the second canopy inner top element 501A (transparent), the first canopy side elements 502 (transparent), the second canopy side elements 503 (transparent), the first door flap 504 (transparent), the second door flap 505 (transparent), and the canopy fold 1200.

In either the first or second exemplary embodiment, a storage net 2100 may be provided. The storage net 2100 provides sheltered storage intended for boating accessories such as life vests, tubes, flotation toys, and the like. The net 2100 is preferably suspended at least between any two of the horizontal supports 601, and may optionally be further affixed to the first main strut 602 or second main strut 603. In the preferred embodiments, as shown in FIGS. 3-4, two cargo nets 2100 are provided on either side of the pier. The front and back edges are suspended between the two horizontal supports 601, and the outer edges are suspended from the main struts 602 and 603. The inner edges are not directly suspended from any structure and terminate in-line with the vertical supports 600. This provides a central access space over the dock 100 to the storage volume created by the net 2100. More generally, the storage net 2100 may be suspended between any two parallel frame elements, including the horizontal supports 601, main struts 602 and 603, and the outer struts 606 and 607. FIG. 22 provides the detail of the preferred net element fasteners. The net 2100 may be fastened at any number of fastening points by a net cord 2200, which wraps around the supporting frame element 2204 and secured via a net cord ball 2201 passed through a net cord loop on the opposite end of the net cord 2200. A double hook 2203 hooks to both the net cord 2200 and the net 2100, as shown. In alternative configurations, hooks may be installed on the relevant frame members or, equivalently, on the net itself, for a bungee net. Additionally, rope knots or alternative netting fasteners may be employed. Additional storage solutions may be installed, for example a single-attachment mesh bag may store water toys, swimwear, or other small items. Additional storage solutions may include a clothesline or equipment hoist (for example, for overhead storage of a kayak).

Figure 9:
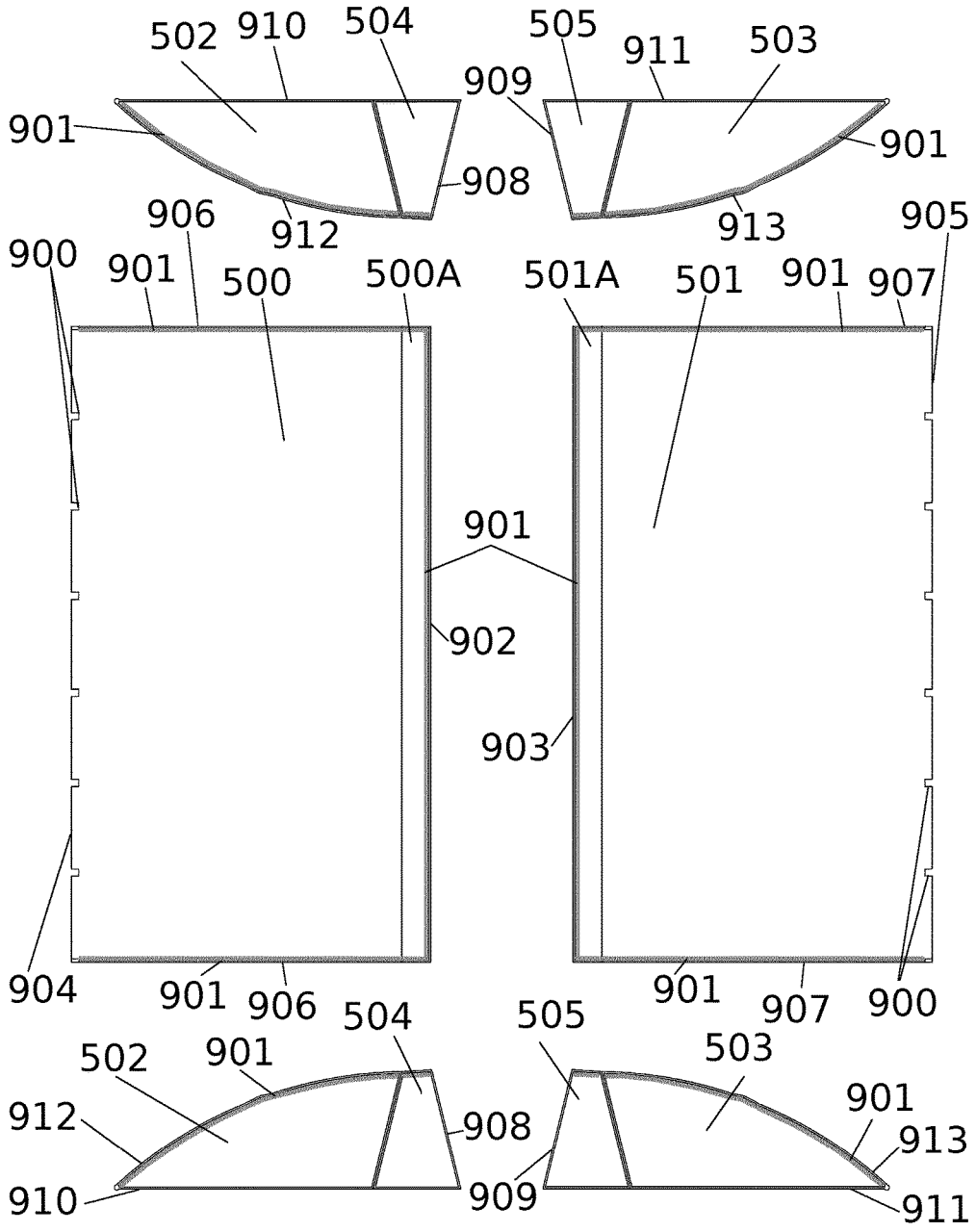
FIG. 9 is a plan view of the components of the canopy cover of the first or second exemplary embodiment, displaying the first canopy top element 500, the first canopy inner top element 500A, the second canopy top element 501, the second canopy inner top element 501A, the first canopy side elements 502, the second canopy side elements 503, the first door flap 504, the second door flap 505, the arch member access notches 900, the canopy cover fasteners 901, the first top element inner edge 902, the second top element inner edge 903, the first top element outer edge 904, the second top element outer edge 905, the first top element side edges 906, the second top element side edges 907, the first side element inner edges 908, the second side element inner edges 909, the first side element bottom edges 910, the second side element bottom edges 911, the first side element curved top edges 912, and the second side element curved top edges 913.
Figure 12:
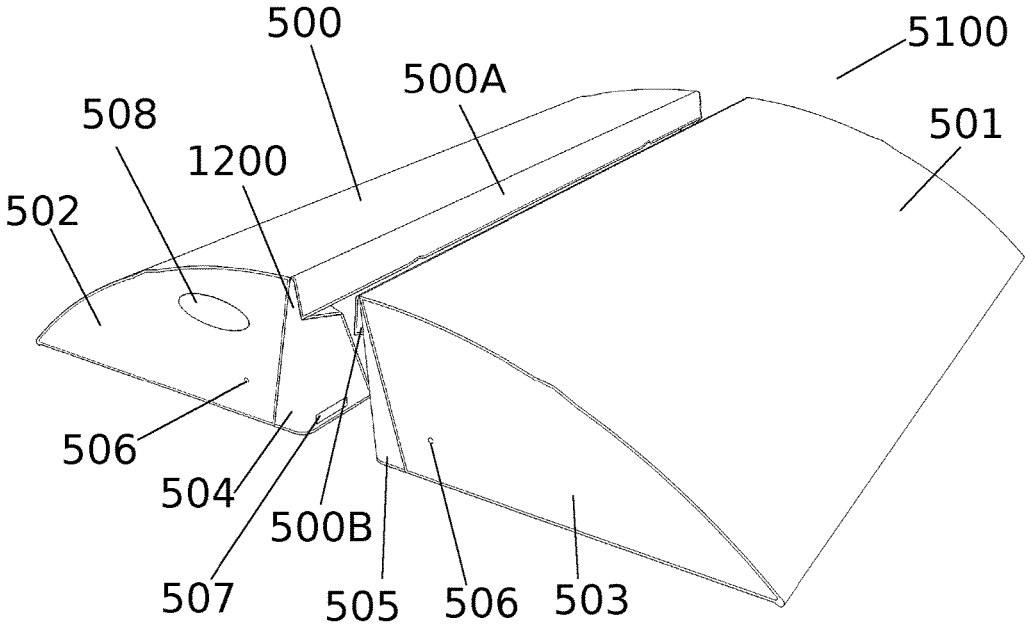
FIG. 12 is an elevated front right perspective view of the canopy cover of the first or second exemplary embodiment with the door flaps in the first installation configuration, displaying the first canopy top element 500, the first canopy inner top element 500A, the second canopy top element 501, the second canopy inner top element 501A, the first canopy side elements 502, the second canopy side elements 503, the first door flap 504, the second door flap 505, the door opening fasteners 506, the logo placement 508, the assembled canopy cover 5100, and the canopy fold 1200.

Referring now to the canopy 5100, shown in disassembled plan view in FIG. 9, the preferred embodiment of the canopy comprises a first canopy top element 500, a second canopy top element 501, a pair of first canopy side elements 502, and a pair of second canopy side elements 503. As shown, the first canopy top element 500 is approximately rectangular and has an inner edge 902, an outer edge 904, and two side edges 906. Similarly, the second canopy top element 501 is approximately rectangular and has an inner edge 903, an outer edge 905, and two side edges 907. Each of the first canopy side elements 502 is defined to have a first side element inner edge 908, a first side element bottom edge 910, and a first side element curved top edge 912. Similarly, each of the second canopy side elements 503 is defined to have a second side element inner edge 909, a second side element bottom edge 911, and a second side element curved top edge 913. The curved top edges 912 and 913 are shaped to match the arc of the first arch elements 604 and the second arch elements 605, respectively. The outside surface of the canopy side elements 502 and/or 503 may have affixed thereto a logo placement 508 whereon branding or other indicia may be printed. Additionally, the first and second canopy top elements 500 and 501 as well as the canopy side elements 502 and 503 may have affixed to their lower edges a loosely hanging skirt of additional material, which may provide added protection against the entry of dirt, wind, and moisture.

Figure 20:
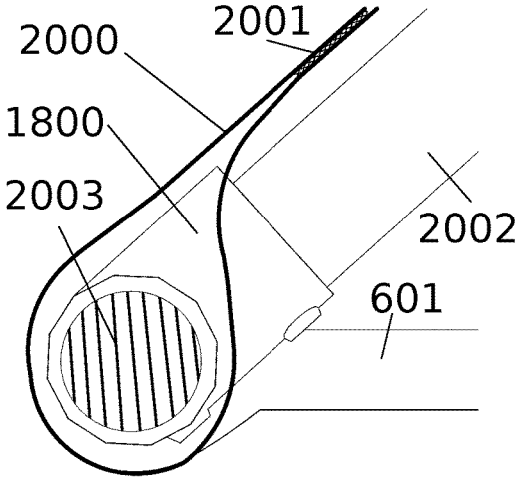
FIG. 20 is a sectional view, along the plane identified in FIG. 5, of the outer struts as the canopy cover is attached thereto of the first or second exemplary embodiment, displaying the horizontal support 601, the T-connector 1800, the canopy cover top element 2000, the canopy cover top fastener 2001, the arch element 2002, and the outer strut 2003.
Figure 21:
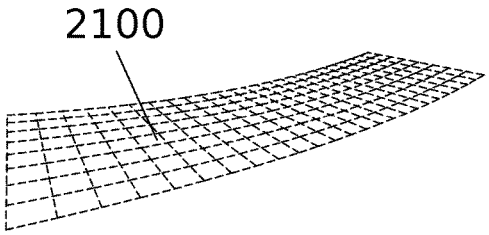
FIG. 21 is a detail view of the storage net element of the first or second exemplary embodiment, displaying the storage net 2100.

The canopy components are joined by canopy cover fasteners 901, which are present along the first top element inner edge 902, the second top element inner edge 903, the first top element side edges 906, the second top element side edges 907, the first side element curved top edges 912, and the second side element curved top edges 913. The canopy cover fasteners 901 may take the form of stitching, zippers, hook and loop fastener strips, buttons, snaps, etc. Along the first top element inner edge 902 and the second top element inner edge 903, the canopy cover fasteners 901 form a top element removable fastening means for removably fastening the first top element 500, along the first top element inner edge 902, to the second top element 501, along the second top element inner edge 903. Thus, in the case of the top element inner edges 902 and 903 removable fasteners, and not stitching, are preferred. Along the first and second side element top edges 912 and 913, and along the first and second top element side edges 906 and 907, the canopy cover fasteners 901 form a side element top edge fastening means for fastening each of the first pair of side elements 502, along the first side element top edge 912, to the first top element 500, along the first top element side edges 906, and for fastening each of the second pair of side elements 503, along the second side element top edge 913, to the second top element 501, along the second top element side edges 907. In the case of the side elements 502 and 503, a non-removable fastening means, i.e. stitching, is preferred. Notably, the first and second canopy top elements 500 and 501 have, within their outer edges 904 and 905, respectively, notches 900, which accommodate the arch members 604 and 605 at T-connectors 1800, as shown in FIG. 20, which shows a cross section the outer strut 2003 (either the first outer strut 606 or the second outer strut 607) and the canopy cover top fastener 2001. The canopy top fastener 2001 is preferably hook and loop fabric strips, though other removable fastening means, such as ties, snaps, buttons, etc. may be employed. In the case of the second exemplary embodiment, pairs of hook and loop fasteners are preferably provided on the inside surface of the first and second top canopy elements 500 and 501 in-line with the first and second inner struts 700 and 701, respectively such that the canopy cover 5100 is affixed to both rotatable portions of the canopy frame 6100.

Figure 13:
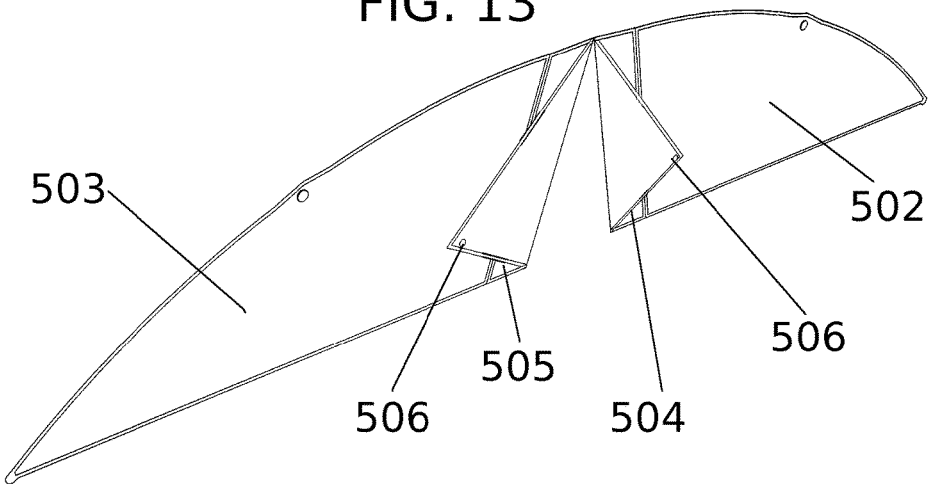
FIG. 13 is a rear left perspective view of the inside of the assembled side elements of the canopy cover first or second exemplary embodiment with the door flaps in the open configuration, displaying the first canopy side elements 502, the second canopy side elements 503, the first door flap 504, the second door flap 505, and the door opening fasteners 506.
Figure 14:
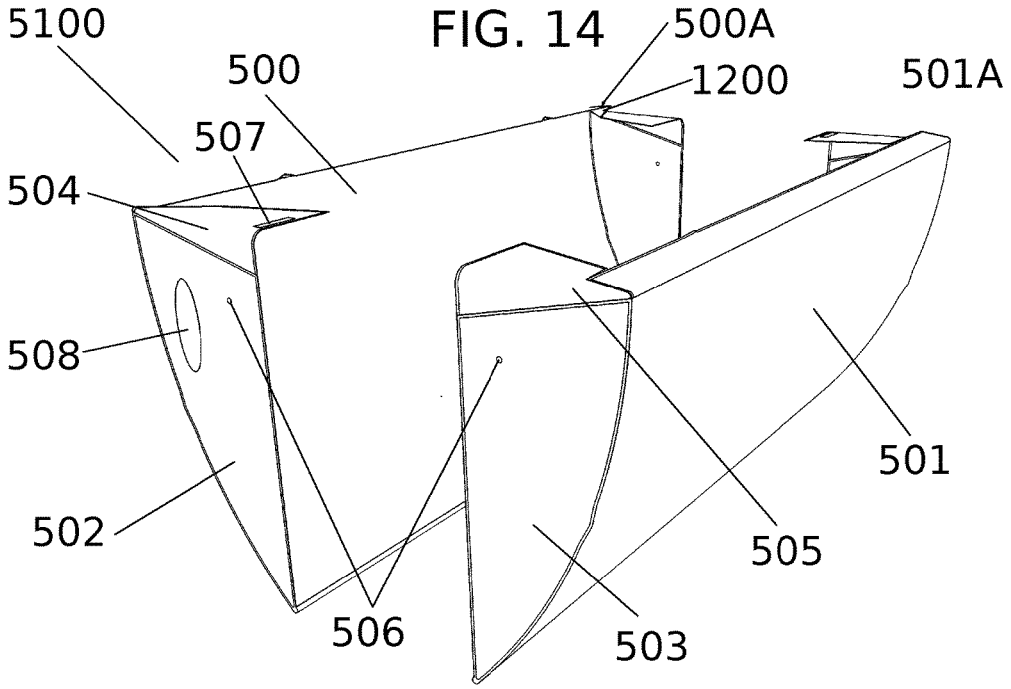
FIG. 14 is an elevated front right perspective view of the canopy cover of the second exemplary embodiment in the second installation configuration, displaying the first canopy top element 500, the first canopy inner top element 500A, the second canopy top element 501, the second canopy inner top element 501A, the first canopy side elements 502, the second canopy side elements 503, the first door flap 504, the second door flap 505, the door opening fasteners 506, the logo placement 508, the assembled canopy cover 5100, and the canopy fold 1200.
Figure 15:
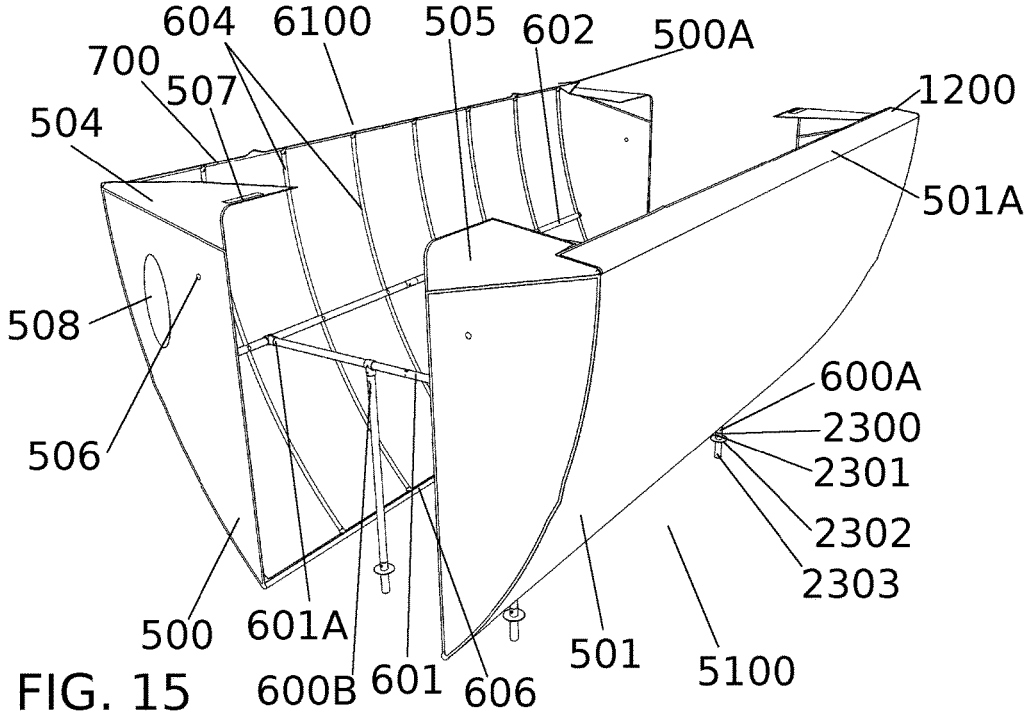
FIG. 15 is an elevated front right perspective view of the canopy cover of the second exemplary embodiment in the second installation configuration in context with the canopy frame elements, displaying the first canopy top element 500, the first canopy inner top element 500A, the second canopy top element 501, the second canopy inner top element 501A, the first canopy side elements 502, the second canopy side elements 503, the first door flap 504, the second door flap 505, the door opening fasteners 506, the logo placement 508, the assembled canopy cover 5100, the vertical supports 600, the vertical support bottom ends 600A, the vertical support top ends 600B, the horizontal supports 601, the horizontal support first ends 601A, the first main strut 602, the first arch members 604, the first outer strut 606, the second outer strut 607, the assembled canopy frame 6100, the first inner strut 700, the canopy fold 1200, the vertical support socket 2300, the vertical support socket fastener 2301, the stop disc 2302, and the insertion member 2303.

The first side element inner edges 908 and the second side element inner edges 909 are removably joined by a side element fastening means for fastening the first pair of side elements 502 to the second pair of side elements 503. To achieve this means in its most generic form, the canopy cover fasteners 901 may be extended over the side element inner edges 908 and 909, which may be made parallel so as to be joined by a zipper, hook and loop fastener strip, buttons, snaps etc. However, in the preferred embodiment, the first side elements 502 and second side elements 503 are both shaped to have a first door flap 504 and second door flap 505, respectively, along their inner edges 908 and 909. The door flaps 504 and 505 preferably overlap and are movable between an open configuration (FIG. 11) and a closed configuration (FIG. 10). With respect to the closed configuration, a door closing fastener 507 is configured for releasably fastening the door flaps 504 and 505 into the closed configuration, and is present on the door flaps 504 and 505, may take the form of a hook and loop fastener strip, or alternatively buttons, snaps, hooks, etc. In embodiments where the door closing fastener 507 is a horizontally oriented hook and loop fastener strip, as shown in FIG. 10, complementary hook and loop fastener faces may be placed on the inside face of one and outside face of the other of the first door flap 504 and second door flap 505; alternatively, complementary hook and loop fastener strips may be placed on both the inside face and outside face of both the first door flap 504 and the second door flap 505. Thus, in the preferred embodiment, the door closing fastener 507 provides the side element fastening means for fastening the first pair of side elements 502 to the second pair of side elements 503. Additionally, the door closing fastener 507 provides a detachable and reattachable closed door flap fastening means for fastening the first door flap 504 and the second door flap 505 in the closed configuration. Further, the door flaps 504 and 505 may be fastened in the open configuration of FIG. 11 provided door opening fasteners 506, which may be snaps, buttons, hooks, hook and loop fasteners, etc. This forms a detachable and reattachable open configuration door flap fastening means for fastening the first door flap 504 and the second door flap 505 in the open configuration. The door flaps 504 and 505 may be fastened open inside or outside of the canopy; the figures show the door flaps 504 and 505 on the inside, for example the inside view of FIG. 13. The angled overlapping shape of the door flaps 504 and 505 provides fault-tolerance for deformation in the shape of the arch members 604 and 605, whether during manufacturing or after installation, for example due to deflection. In various embodiments, this fault tolerance is achieved by the door closing fastener 507 being a horizontally (or, inline with the direction of overlap) positioned hook and loop fastener strip, as depicted in FIGS. 5 and 10, allowing the degree of overlap of the door flaps 504 and 505 to be adjusted. Further, the particular angled shape referenced herein may be understood, as depicted in FIGS. 5 and 10, as each of the door flaps 504 and 505 being acutely angled as measured between the door flap edge 504A or 505A and the horizontal, and with the vertex being located at the corner of the corresponding side element 502 or 503. Accordingly, the triangular overlap region 590 between the door flaps 504 and 505 is triangular in shape with the scale of the triangle dependent on the degree of overlap. As shown, the door closing fastener 507 is located within the triangular overlap region 590. Further, as shown, the door closing fastener 507 is translationally adjustable (translationally, as used here, meaning in the long dimension of the hook and loop fastener strip, as opposed to in the short dimension (distally) or some other angle (rotationally)), which allows the size of the overlap region to be scaled, thus accounting for deflection by allowing the fit of the canopy cover 5100 to be corrected. As an alternative, the door flaps 604 and 605 may be replaced by a single roll-up or pull-up drapery style covering.

The canopy top elements 500 and 501 are preferably made from a waterproof or water resistant vinyl, canvas, or other fabric covering. The canopy side elements 502 and 503 may be made of a similar material. In the preferred embodiment, however, a portion of the top elements 500 and 501, specifically a rectangular region along the inner edges 902 and 903, may be understood as the first canopy inner top element 500A and the second canopy inner top element 501A. These and the canopy side elements 502 and 503, including the door flaps 504 and 505, are preferably made of a transparent material, for example, a transparent mesh fabric material or a clear vinyl material. FIGS. 3-4, 34-43 display the transparency effect in scene view. The transparency allows light to enter such that the user can see the surrounds during daylight via the inner top elements 500A and 501A, and to see the contents of the canopy from outside or approaching persons or watercraft from inside, via the side elements 502 and 503 and door flaps 504 and 505. Additionally, where a transparent mesh screening material (which is preferable) is used, the structure has superior air venting properties, which minimize air drag forces during storms and weather, and also allow for heat and moisture to be vented from the canopy interior. Further, in the second exemplary embodiment, the interface between the main material of the first and second canopy top elements 500 and 501 may provide a wedge (or a dedicated wedge may be provided) into which a reinforcement element 1900, a flat flexible plastic strut, may be frictionally inserted; this maintains the arch of the canopy in the top region between the inner struts 700 and 701.

FIGS. 8, 14-15, 40-43 show the installation configuration of the second exemplary embodiment with the preferred canopy. The second exemplary embodiment is assembled and the main struts 602 and 603 are allowed to rotate such that the arch members are tilted upward as in the first installation configuration of FIG. 8. The canopy 5100 is then assembled in halves as in FIG. 14, and draped over the canopy frame 6100 in the installation configuration, as in FIG. 15. Thus, the canopy frame 6100 may be understood as including a pair of barrel vault halves, as shown, which include the arch members 604 and 605, the outer struts 606 and 607, and the inner struts 700 and 701. The pair of barrel vault halves may be understood as rotatably affixed to and supported by the horizontal supports 601, which are affixed to and supported by the vertical supports 600. The main struts 602 and 603 may then be rotated back into the use configuration and, optionally, secured there, yielding the second installation configuration of FIGS. 40-43. The user may then fasten the canopy top elements 500 and 501 together using the canopy cover fasteners 901 and fasten the door flaps 504 and 505 in the open or closed configuration to achieve an overall use configuration.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A structure comprising:

at least two vertical supports;

a canopy frame;

said at least two vertical supports supporting said canopy frame;

said canopy frame being cantilevered out from said at least two vertical supports in at least two opposing directions; and said canopy frame comprising a pair of main struts, each located distally to said at least two vertical supports in said at least two opposing directions, and a plurality of frame members each supported centrally by only one of said pair of main struts.

2. The structure of claim 1, wherein said at least two vertical members are affixed to opposite sides of a watercraft dock that divides two distinct watercraft mooring areas, and said canopy frame extends over said two distinct watercraft mooring areas and said dock, and such that said canopy frame is cantilevered out distally from said at least two vertical supports and said dock in each of said at least two opposing directions.

3. The structure of claim 2, wherein said canopy frame defines a barrel vault that provides unobstructed enclosed access to both said at least two distinct watercraft mooring areas and said dock.

4. The structure of claim 3, wherein said barrel vault comprises a pair of barrel vault halves, each rotatably affixed to and supported by one of said pair of main struts, and each of said pair of barrel vault halves is weight-balanced about that of said pair of main structs to which it is affixed.

5. The structure of claim 2, wherein:

said watercraft dock is a floating dock;

said floating dock comprises at least one extra guide hole;

at least one of said at least two vertical supports being affixed to said watercraft dock by insertion into a socket of an insertion member, said insertion member being inserted into one of said at least one extra guide hole; and said insertion member being surrounded by and affixed to a rigid top disc, said rigid top disc being larger in diameter than said one of said at least one extra guide hole, such that said rigid top disc rests on said watercraft dock above said one of said at least one extra guide hole.

6. The structure of claim 1, wherein said canopy frame lacks cross-bracing of any cantilevered element.

7. A structure comprising:

at least two vertical supports;

a canopy frame;

said at least two vertical supports supporting said canopy frame;

said canopy frame being cantilevered out from said at least two vertical supports two opposing directions;

said canopy frame comprising a first main strut positioned distally to said at least two vertical supports in a first direction of said two opposing directions and a second main strut positioned distally to said at least two vertical supports in a second direction of said two opposing directions;

said canopy frame comprising a first plurality of arch members and a second plurality of arch members, each of said first plurality of arch members and each of said second plurality of arch members comprising an outer end, and inner end, and a central attachment point;

said central attachment point of each of said first plurality of arch members being affixed to said first main strut;

said central attachment point of each of said second plurality of arch members being affixed to said second main strut;

said outer end of each of said first plurality of arch members being cantilevered out from said first main strut in said first direction;

said outer end of each of said second plurality of arch members being cantilevered out from said second main strut in said second direction;

said inner end of each of said first plurality of arch members being positioned distally from said first main strut in said second direction; and said inner end of each of said second plurality of arch members being positioned distally from said second main strut in said first direction.

8. The structure of claim 7, wherein said inner end of each of said first plurality of arch members is removably and rigidly affixed, via a distinct straight connector component, to said inner end of one of said second plurality of arch members to form a continuous arch shape.

9. The structure of claim 7, wherein said inner end of each of said first plurality of arch members supports a first inner strut, and said inner end of each of said second plurality of arch members supports a distinct second inner strut.

10. The structure of claim 9, further comprising:

at least one horizontal support affixed to a pair of said at least two vertical supports, said first main strut, and said second main strut;

said at least one horizontal support being aligned to said two opposing directions; and at least one secondary vertical support affixed to said at least one horizontal support and either said first inner strut or said second inner strut.

11. The structure of claim 7, wherein said first main strut and said second main strut are cantilevered out from said at least two vertical supports in at least one longitudinal direction, said longitudinal direction being horizontal and perpendicular to said two opposing directions.

12. A structure, comprising:

a canopy frame;

said canopy frame defining a barrel vault having a longitudinal dimension and a transverse dimension, said longitudinal dimension and said transverse dimension being horizontal and perpendicular to one another such that two ends of said barrel vault are orthogonal to said longitudinal dimension;

a watercraft dock aligned to said longitudinal dimension and positioned under said barrel vault;

said barrel vault being supported by at least two vertical supports affixed to said dock on opposite transverse sides thereof;

said watercraft dock dividing two distinct watercraft mooring areas, each distal to said watercraft dock in opposite transverse directions; and said barrel vault being cantilevered over both of said two distinct watercraft mooring areas in opposing transverse directions.

13. The structure of claim 12, wherein:

said watercraft dock is a floating dock;

said floating dock comprises at least one extra guide hole;

at least one of said at least two vertical supports being affixed to said watercraft dock by insertion into a socket of an insertion member, said insertion member being inserted into one of said at least one extra guide hole; and said insertion member being surrounded by and affixed to a rigid top disc, said rigid top disc being larger in diameter than said one of said at least one extra guide hole, such that said rigid top disc rests on said watercraft dock above said one of said at least one extra guide hole.

14. The structure of claim 12, wherein said barrel vault comprises a pair of barrel vault halves, rotatably affixed to, weight-balanced about, and supported by at least one horizontal support, said at least one horizontal support being affixed to and supported by said at least two vertical supports.

15. The structure of claim 12, wherein said barrel vault provides unobstructed enclosed access to said dock and both of said two distinct watercraft mooring areas.

16. The structure of claim 12, wherein said barrel vault is cantilevered out from said at least two vertical supports in both directions of said longitudinal dimension.

17. The structure of claim 12, wherein said barrel vault is open and unobstructed at both of said two ends.

18. The structure of claim 12, wherein the combination of said canopy frame, said at least two vertical supports, and said watercraft dock comprises at least one joint removably connected using a connector whose shape is selected from the group consisting of a straight connector, a right-angle connector, and a T-connector, said connector comprising a welded nut threaded with an hex key bolt, such that said structure is configured to be assembled and stricken seasonally.

19. The structure of claim 18, wherein said hex key bolt for each instance of said connector in said combination is of a same size, whereby said structure is configured to be assembled and stricken with a single hex wrench of said same size.

* * * * *